US011453962B2

(12) United States Patent
Pietzonka et al.

(10) Patent No.: US 11,453,962 B2
(45) Date of Patent: Sep. 27, 2022

(54) WEAVING METHOD, WEFT SELECTOR FOR IMPLEMENTING SUCH A METHOD AND WEAVING LOOM INCORPORATING SUCH A WEFT SELECTOR

(71) Applicant: STAUBLI BAYREUTH GMBH, Bayreuth (DE)

(72) Inventors: Dieter Pietzonka, Hummeltal (DE); Eric Rade, Heinersreuth (DE)

(73) Assignee: STAUBLI BAYREUTH GMBH, Bayreuth (DE)

( * ) Notice: Subject to any disclaimer, the term of this patent is extended or adjusted under 35 U.S.C. 154(b) by 62 days.

(21) Appl. No.: 17/163,670

(22) Filed: Feb. 1, 2021

(65) Prior Publication Data

US 2021/0238780 A1 Aug. 5, 2021

(30) Foreign Application Priority Data

Feb. 3, 2020 (EP) ..... 20155203

(51) Int. Cl.

| | |
|---|---|
| ***D03D 47/34*** | (2006.01) |
| ***D03D 49/70*** | (2006.01) |
| *D03D 49/00* | (2006.01) |

(52) U.S. Cl.

CPC ..... *D03D 47/34* (2013.01); *D03D 49/70* (2013.01)

(58) Field of Classification Search

CPC ..... D03D 47/34; D03D 49/70; D03D 47/125; D03D 47/38; D03D 47/23; D03D 47/275;

(Continued)

(56) References Cited

U.S. PATENT DOCUMENTS 4,458,729 A * 7/1984 Brouwer ..... D03D 47/302 242/365.3
5,425,399 A * 6/1995 Shindo ..... D03D 47/34 139/452

(Continued)

FOREIGN PATENT DOCUMENTS

DE 2531954 A1 2/1976
DE 102015217356 B3 10/2016

(Continued)

OTHER PUBLICATIONS

European Search Report dated May 5, 2020, for Europe Patent Application No. 20155203.1 filed Feb. 3, 2020.

*Primary Examiner* — Robert H Muromoto, Jr.

(57) ABSTRACT

This method is for weaving a fabric with warp yarns and in-woven weft yarns (34) on a weaving loom which comprises, amongst others, a weft selector (28) and a weft insertion mechanism (20), for drawing-in a weft yarn from a pick-up position into the shed, along a weft insertion axis (Y20) and in a forward direction, the weft insertion mechanism including a gripper (40) openable at the pick-up position. This method includes at least the following steps: opening the gripper; positioning a movable carriage (102) of the weft selector so that the gripper (40) is aligned with a selected weft yarn (34); clamping the weft yarn in the selected distribution channel (130), with the clamp (164) of this channel; moving the weft yarn (34) along the selected distribution channel (130) toward the gripper (40), while the gripper is opened, by moving the clamp along the selected distribution channel; catching the selected weft yarn with the gripper at the pick-up position; drawing-in the weft yarn with the weft insertion mechanism, from the pick-up position into the shed, along the weft insertion axis and in the forward direction; and cutting the weft yarn. The weft selector defines several selectable distribution channels (Continued)

(130) parallel to the weft insertion axis (Y20), each selectable distribution channel including a forward guiding member (126), for guiding a weft yarn toward the gripper, and a clamp (164).

18 Claims, 14 Drawing Sheets

(58) Field of Classification Search
CPC .... D03D 49/50; D03D 41/004; D03D 47/271; D03D 47/36; D03C 9/02; D03J 1/04
See application file for complete search history.

(56) References Cited

U.S. PATENT DOCUMENTS 7,879,195 B2 * 2/2011 Quigley ..... D21F 11/006 162/903
8,002,950 B2 * 8/2011 Quigley ..... D21F 11/006 162/903
11,091,857 B2 * 8/2021 Siebert ..... D03D 27/10
2007/0137778 A1 * 6/2007 Dunleavy ..... B29C 70/24 156/256
2009/0223588 A1 * 9/2009 Dunleavy ..... B29C 70/00 139/384 R
2010/0323574 A1 * 12/2010 Dunleavy ..... D03D 25/005 442/203
2014/0349538 A1 * 11/2014 Marchal ..... F01D 5/147 156/227
2020/0270779 A1 * 8/2020 Siebert ..... D03D 11/00

FOREIGN PATENT DOCUMENTS

DE 202019101093 U1 3/2019
FR 2520011 A1 7/1983

* cited by examiner

WEAVING METHOD, WEFT SELECTOR FOR IMPLEMENTING SUCH A METHOD AND WEAVING LOOM INCORPORATING SUCH A WEFT SELECTOR

TECHNICAL FIELD OF THE INVENTION

The present invention concerns a method for weaving a fabric with warp yarns and inwoven weft yarns on a weaving loom. This invention also concerns a weft selector, which allows implementing such a method, and a weaving loom, which incorporates, amongst others, such a weft selector.

The technical field of the invention is the field of weaving of bi-dimensional or three-dimensional fabrics, where different weft yarns, for instance different carbon yarns, are woven thanks to a multi-weft selector.

BACKGROUND OF THE INVENTION

It is known from EP-A-3 121 317 to weave carbon weft yarns of different sizes with a process where the length of the weft yarn can be adjusted. This prevents over-consumption of weft material. A weft delivery unit is provided. Its structure does not allow easy selection of a weft yarn to be used for the next pick.

On the other hand, US-A-2012/0125476 discloses using a rotational movement of two swivel arms to insert into the shed one of two different weft materials. This rotational movement is relatively imprecise. This approach is limited to two different weft yarns only. The extremity of the weft material can be loose after cutting and protrudes out of a swivel unit on a short length, so as it might be missed by a gripper of an insertion rapier. Moreover, in this device, a motor is needed for each swivel unit, which is expensive and bulky. Furthermore, the tapes are usually bent around their main axis thanks to specific clamp shape, which may be more or less concave, to bring stiffness at their extremity, which is imprecise and not universal.

It is also known from DE-A-2531954 to use a weft selector device provided with several selectors in order to draw some weft yarns into the shed of a loom. A problem with this weft selector device is that the feeding device is not adapted to move forward and take a weft in the weft direction. In addition, in this known selector, the weft yarn is presented perpendicularly to the weft insertion direction, which is not possible with fragile yarns.

A multi weft selector, suitable for traditional weaving, is known from FR-A-2 520 011. A vertical fork is provided with two branches defining a flat space where different weft yarns extend perpendicularly to the direction of movement of a weft insertion member. The fork is vertically movable in order to position one of the weft yarns in front of the weft insertion member. This weft selector cannot be used with relatively rigid weft yarns, such as carbon weft yarns. Indeed, because of the perpendicularity between the path of the weft insertion member and the weft yarns located between the branches of the fork, a relatively strong shearing force is exerted on the weft material. This device tears the weft yarns through the shed, which is not possible with carbon yarns and other weft yarns which must be nicely cut and picked up at their free extremities, in order not to damage the weft material.

SUMMARY OF THE INVENTION

This invention aims at solving the above listed problems by providing a new weaving method which is highly versatile and compatible with many weft materials, in particular, with multiple carbon weft yarns.

To this end, the invention concerns a method for weaving a fabric with warp yarns and in-woven weft yarns on a weaving loom which comprises heddles for moving the warp yarns in order to form a shed, a shed forming mechanism for moving the heddles, weft bobbins which provide weft yarns to the loom, a weft insertion mechanism, for drawing-in a weft yarn from a pick-up position into the shed, along a weft insertion axis and in a forward direction, the weft insertion mechanism including a gripper openable at the pick-up position, and a weft selector defines several selectable distribution channels parallel to the weft insertion axis, each selectable distribution channel including a forward guiding member, for guiding a weft yarn toward the gripper, and a clamp. This method includes at least the following steps:

a) opening the gripper;
b) positioning a movable carriage of the weft selector, by aligning a selected distribution channel on the weft insertion axis, so that the gripper is aligned with a selected weft yarn;
c) clamping the weft yarn in the selected distribution channel, with the clamp of this channel;
d) moving the weft yarn along the selected distribution channel toward the gripper, while the gripper is opened, by moving the clamp along the selected distribution channel;
e) catching the selected weft yarn with the gripper at the pick-up position;
f) drawing-in the weft yarn with the weft insertion mechanism, from the pick-up position into the shed, along the weft insertion axis and in the forward direction; and
g) cutting the weft yarn.

In the meaning of the invention, a warp yarn can be of any known type, with a circular, oval or rectangular cross section, or a rectangular cross section with rounded edges, and made of any material, in particular a relatively rigid material such as carbon, glass, ceramic, aramid or Kevlar. When the warp yarn has a rectangular or oval-like cross section, it can also be named a ribbon, a tape or a band.

Owing to the invention, one can use the selectable distribution channels of the weft selector to feed the weft insertion mechanism with different weft yarns aligned on the weft insertion axis, without a need for bending these weft yarns. Actually, since the selected distribution channel is aligned with the weft insertion axis, the weft yarn can go straight from the distribution channel into the shed. In addition, clamping the weft yarn and moving it along the selected distribution channel facilitates catching of its free extremity by the gripper of the weft insertion mechanism.

According to advantageous optional aspects of the invention, such a method may incorporate one or several of the following features, considered in any technically allowable configuration:

Clamping of the weft yarn is released during step f).

The method includes, after step e), the following step:

h) moving backward the weft yarn in the selected distribution channel, along the weft insertion axis, in a direction away from the gripper, preferably on a stroke inferior to a distance by which the weft yarn protrudes from the forward guiding member towards the gripper, along the weft insertion axis, prior to the beginning of the backward movement.

The weft yarn is guided by the forward guiding member during step h).

The weft yarn is clamped by the clamp of the selected distribution channel during step h).

The weft yarn of the selected distribution channel is braked during step f).

The weft yarn of the selected distribution channel is cut at a preset length during step g) and the method includes, after step g), the following step:

i) drawing, in the forward direction, the cut weft yarn at a preset position into the shed.

The method includes, before step b), the following step:

j) lifting the weft insertion mechanism and the weft selector vertically or holding them in a vertical position, in order to adjust the vertical position of the weft insertion axis and of the selected distribution channel.

The method includes, after step e) and before step g), the following step:

j) moving backward the clamp in the selected distribution channel, along the weft insertion axis, in a direction away from the gripper.

The method includes, after step d) and before step e), the following steps:

d1) opening the clamp;

d2) moving the clamp backward along the selected distribution channel;

d3) clamping the weft yarn with the clamp;

d4) moving the weft yarn along the selected distribution channel further than in step d) into the gripper, while the gripper is opened at the pick-up position, by moving the clamp along the selected distribution channel.

According to another aspect, the invention also relates to a weft selector for delivering a weft yarn to a weft insertion mechanism for drawing-in a weft yarn from a pick-up position into a shed of a weaving loom, in a forward direction along a weft insertion axis, the weft insertion mechanism including a gripper openable at the pick-up position and movable along the weft insertion axis, the weft selector including a movable carriage. The movable carriage defines two planes offset along the weft insertion axis, namely a forward plane and a backward plane, forward guiding members are positioned in the forward plane and backward guiding members are positioned in the backward plane. Moreover, the movable carriage defines several distribution channels parallel to the weft insertion axis, each distribution channel extending between a forward guiding member and a backward guiding member. The carriage is configured for aligning a selected distribution channel on the weft insertion axis, each distribution channel is equipped with a clamp configured for holding a weft yarn in the distribution channel and mobile along the distribution channel in a forward direction and in a backward direction, between a feeding position, where the weft yarn extends into the pick-up position, and a retracted position, where the weft yarn is offset from the pick-up position along the weft insertion axis. A drive moves the clamp of the selected distribution axis along the weft insertion axis.

This weft selector provides substantially the same advantages as the above mentioned method. In particular, different weft materials can be provided to the weft insertion mechanism, while being in alignment with a rapier or another type of weft insertion means, so that the weft yarn is not damaged nor twisted but secured, during the transfer between the weft selector and the weft insertion mechanism.

According to some other advantageous but optional aspects of the invention, such a weft selector may incorporate one or several of the following features, considered in any technically allowable combinations:

The movable carriage is movable along an axis perpendicular to the weft insertion axis.

Between its feeding position and its retracted position, the clamp has a stroke smaller than or equal to 12 mm, preferably smaller than or equal to 10 mm, still preferably smaller than or equal to 5 mm.

The weft selector includes a single clamp drive which is configured to selectively apply an opening force on the clamp of the distribution channel aligned with the weft insertion axis.

Each distribution channel is equipped with a weft presenter, which supports the clamp, and an elastic return means, configured to push back the weft presenter towards the retracted position of the clamp and the weft selector includes a single drive assembly for moving along the weft insertion axis, the weft presenter of any distribution channel aligned with the weft insertion axis.

The weft selector includes a basket, which is configured for guiding the gripper, at the pick-up position.

The weft selector i includes three drive assemblies, namely:

a first drive assembly for positioning the movable carriage;

a second drive assembly for opening of the clamp of a distribution channel aligned with the weft insertion axis, when this clamp is in the feeding position;

a third drive assembly for moving, along the weft insertion axis, the clamp of the distribution channel aligned with the weft insertion axis toward the feeding position.

According to a third aspect, this invention relates to a weaving loom comprising heddles for moving warp yarns in order to form a shed, a shed forming mechanism for moving the heddles, weft bobbins which provide weft yarns to the loom, a weft insertion mechanism, for drawing-in a weft yarn from a pick-up position into the shed, along a weft insertion direction, the weft insertion mechanism including a gripper openable at the pick-up position, and a weft selector as mentioned here-above.

This loom provides the same advantages as the method and the weft selector of the invention.

BRIEF DESCRIPTION OF THE DRAWINGS

The invention will be better understood and other advantages thereof will appear more clearly, upon reading of the following description of an embodiment of a weaving method, a weft selector and a loom according to the invention, this description being provided solely as an example and made in reference to the appended drawings in which.

DETAILED DESCRIPTION OF SOME EMBODIMENTS

Figure 1:
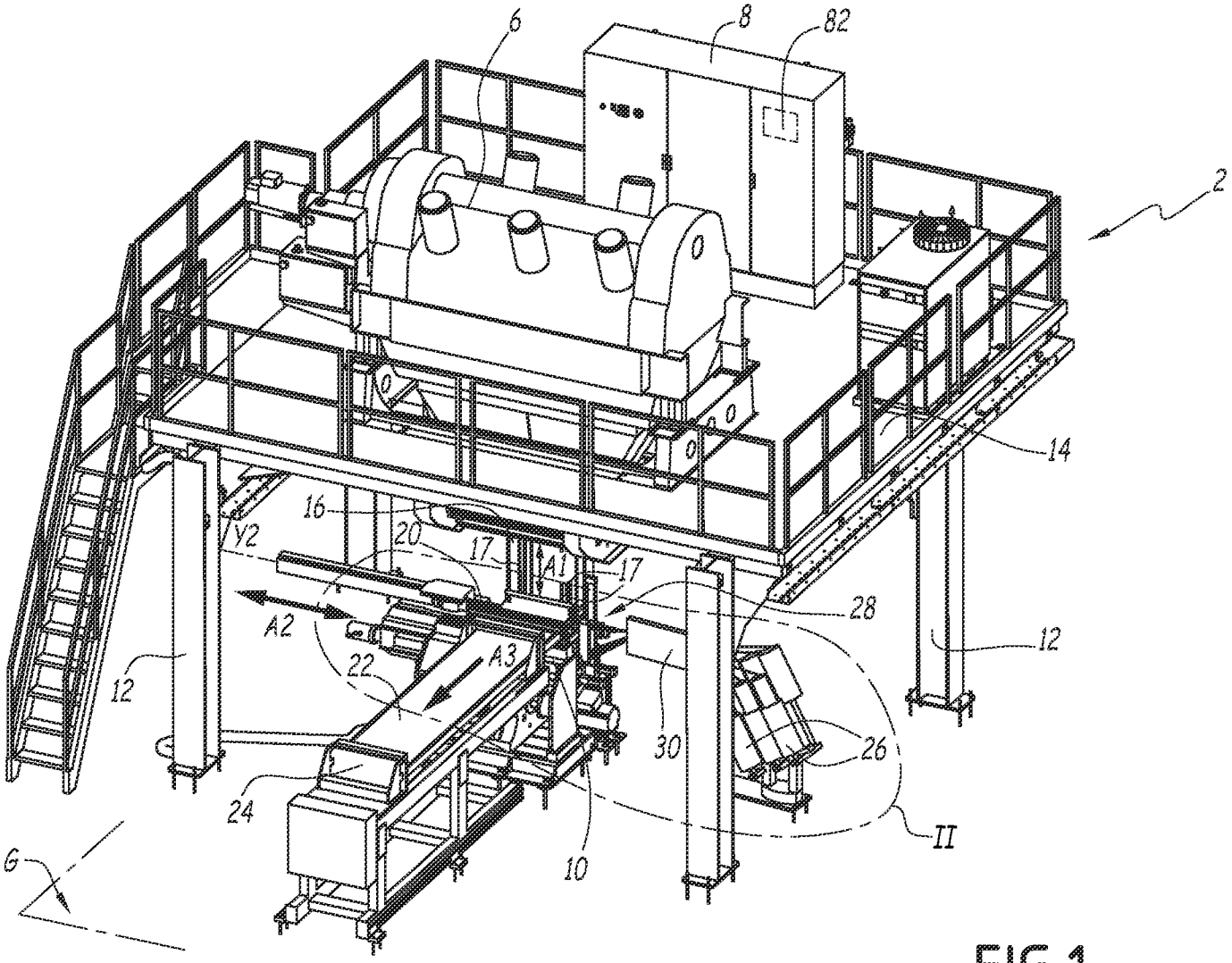
FIG. 1 is a schematic perspective view of a weaving loom according to the invention.

The weaving loom 2 represented of FIG. 1 includes a gantry 4, which supports a Jacquard machine 6 and some control cabinets 8 above a weaving machine 10 fixed on the ground G. The gantry 4 has several posts 12 also fixed on the ground, which support together a platform 14, where the Jacquard machine 6 and the control cabinets 8 are located.

A harness 16, made of heddles 17 and non-represented cords, is vertically movable to form a non-represented shed, at the level of the weaving machine 10, with warp yarns 18 coming from a non-represented creel.

The alternative vertical movement of the harness cords and heddles 17 is represented by double arrow A1 on FIG. 1.

A rapier 20 is used for inserting weft yarns 34 into the shed in order to weave a fabric 22. On FIGS. 1 and 2, double arrow A2 represents the alternative horizontal movement of the rapier 20 along a weft insertion axis Y20, when it is guided by a rail 201 of a rapier unit 200, which forms a weft insertion mechanism and also includes a non-represented drive for moving back and forth the rapier 20 along the weft insertion axis Y20.

Arrow A3 represents the unidirectional displacement of the woven fabric 22 towards a take-up carriage 24.

A reed 23 is used for beating the weft yarns 34 into the fabric 22 after each pick. Double arrow A23 represents the beating movement of the reed on FIGS. 2 and 14.

The weft yarns 34 unwind from bobbins 26 located next to the weaving machine 10 and are presented to the rapier 20 by a weft selector 28 fed from the bobbins via a compensator 30, known per se and designed to avoid shaking in the supply of weft yarns. The compensator 30 guarantees a substantially constant tension of the weft yarns 34 leaving this compensator.

In the example of the figures, six bobbins 26 are mounted on a support bracket 32 fixed on the ground G, next to weft selector 28 and to the compensator 30. The weft selector 28 can be fed with weft yarns coming from up to twelve bobbins 26. The number of bobbins 26 can be increased in order to match the number of different weft yarns to be used in the weaving loom 2.

In this example, the warp yarns 18 are made from polyester, polyamide or other relatively cheap thermoplastic material. Alternatively, these warp yarns can be made from glass, carbon or another more elaborated material for generating three dimensional technical multilayer fabrics, for instance for a blade of a propeller, or two dimensional multilayer fabrics, for instance for a technical part of an automotive.

The weft yarns 34 a made from reinforced plastic or from fibers, such as carbon, Kevlar, ceramic, aramid or glass. As mentioned here above, these yarns can have a circular, oval, rectangular cross section, or an approximatively rectangular cross section with rounded edges. They can form circular yarns, tapes, bands or ribbons, with a width between 0.014 mm and 5 mm.

The weft selector 28 includes a vertically movable carriage 102 which can be displaced, with respect to the ground G, along a vertical axis Z28. The weft selector 28 can be displaced by an electric drive assembly 103 comprising an electric motor 104, a belt 106 and non-represented pulleys incorporated into upper and lower direction-change boxes 108. Two guides rails 110 extend vertically between the two boxes 108 and also belong to the drive assembly 103. The drive assembly 103 is piloted by an electronic control unit, or ECU, 82 incorporated in one of the cabinets 8. This ECU includes at least one microprocessor and a memory, with a program for piloting the weft selector 28.

The vertically movable carriage 102 includes an upper cross beam 112 and a lower cross beam 114 adapted to slide along the guide rails 110 when pulled upwardly or downwardly by the belt 106. The carriage 102 also includes a forward bracket 116 and a backward bracket 118. The notion of "forward" and/or "backward" relates to the direction of movement of the rapier 20 when it moves from a weft yarn pick-up position into the shed formed by the warp yarns 18, along a weft insertion axis Y20. A forward movement of the rapier 20 goes from the right to the left, along axis Y20, on FIGS. 1 to 10. This is why bracket 116 is located forward of bracket 118 along axis Y20.

The forward bracket 116 is provided with forward eyelets 126 aligned along an axis Z116 parallel to axis Z28. Similarly, the backward bracket 118 is provided with backward eyelets 128 aligned along an axis Z118 parallel to axis Z28.

A median plane P116 of the forward bracket 116 is defined between its forward and backward surfaces, at equal distances of these two surfaces. A median plane P118 of the backward bracket 118 is defined between its forward and backward surfaces, at equal distances of these two surfaces. These two median planes P116 and P118 are parallel and respectively form a forward plane and a backward plane for the movable carriage 102. They are perpendicular to axis Y20 and offset along this axis. The forward and backward eyelets 126 and 128 are respectively positioned in the forward plane P116 and in the backward plane P118. In other words, the forward and backward eyelets 126 and 128 respectively cross the median planes P116 and P118.

Each forward eyelet 126 is aligned with a backward eyelet 128, in the direction of a longitudinal axis Y130 parallel to axis Y20. A forward eyelet 126 and a backward eyelet 128, aligned with this forward eyelet along an axis Y130, together define a cylindrical volume 130 called "distribution channel", which extends, between the forward and backward brackets 116 and 118, along this longitudinal axis Y130. Each distribution channel is parallel to axis Y20. Alternatively each distribution channel is likely parallel to axis Y20. The longitudinal axis Y130 of each distribution channel 130 is tangent to the lower portions of the two eyelets 126 and 128 defining this distribution channel. Thus, a weft yarn 34 lying on the lower portions of the two eyelets 126 and 128 of a distribution channel 130 extends along its longitudinal axis Y130.

Figure 4:
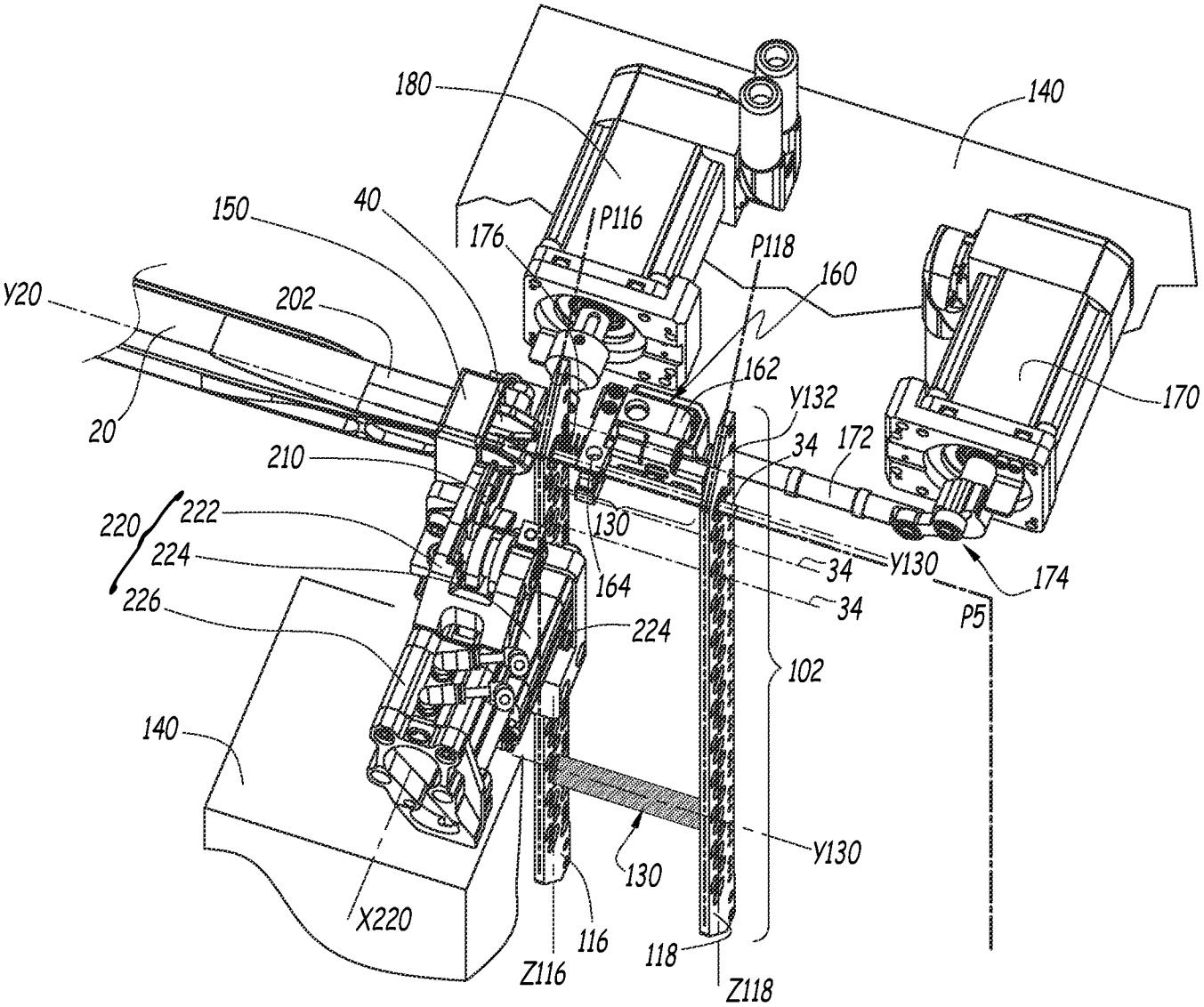
FIG. 4 is a top perspective view of some of the parts represented on FIG. 3 and a part of a rapier of the loom, when the weft selector and the loom are in a first working configuration.

A distribution channel 130 is identified, as an example, by a grey zone on FIG. 4.

A weft yarn 34 can slide along each distribution channel 130, in the direction of its longitudinal axis Y130, in order to be caught by a gripper 40 of rapier 20, in the pick-up position, outside of this distribution channel 130, as explained here-below.

The forward and backward eyelets 126 and 128 are made by rings mounted in holes made in the forward and backward brackets 116 and 118, these brackets having a thickness, measured parallel to axis Y20, of about 5 mm whereas the eyelets have a diameter of about 3 mm and rounded edges. Thus, the eyelets offer smooth guiding surfaces for a weft yarn 34 sliding along a distribution channel 130 defined between two aligned eyelets 126 and 128.

Alternatively, the eyelets 126 and 128 are made by holes drilled directly through the brackets 116 and 118, these holes having also rounded edges in order to offer also smooth guiding surfaces for a weft yarn 34.

In the example of the figures, all eyelets 126 and 128 are identical. This is not compulsory and the size and shape of the eyelets can be adapted along the height of a bracket 116 or 118, in order to adapt to the size and cross-section of the weft yarn 34 travelling through a distribution channel 130.

In this example, each forward or backward bracket 116 or 118 is provided with twelve forward or backward eyelets 126 or 128, so that twelve distribution channels 130 are defined between these brackets; one on above the other, in the direction of axis Z28. Thus, twelve different weft yarns 34, coming from twelve different bobbins 26 can be handled in the weft selector 28.

The number of eyelets per bracket, thus the number of distribution channels 130, is not limitative, provided that this number is at least equal to 2. Preferably the number of distribution channels 130 is at least 3, more preferably at least 5 and still more preferably at least 12.

Figure 3:
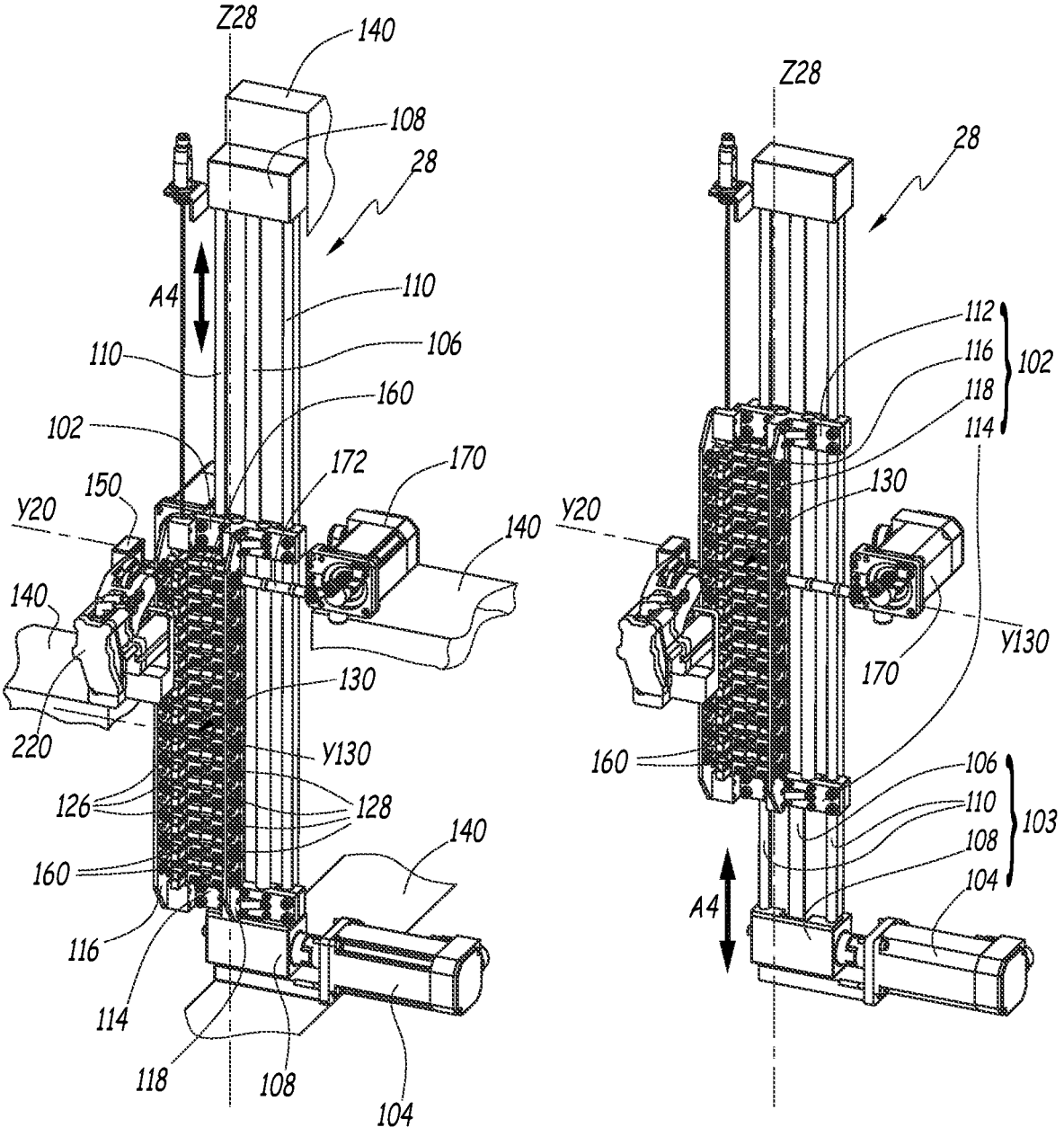
FIG. 3 is an enlarged perspective representation, in two different configurations of some parts of a weft selector according to the invention, which belongs to the loom of FIGS. 1 and 2.

140 denotes a frame of the weft selector 28, this frame being partly represented on the left of FIG. 3 and on FIG. 4 only, for the sake of simplicity and clarity. The boxes 108 and the guide rails 110 are stationary with respect to the frame 140.

Thanks to the drive assembly 103, it is possible to move the carriage 102 along axis Z28, upwardly or downwardly, with respect to the frame 140 and to the ground G, as shown by double arrows A4 on FIG. 3.

This allows aligning a selected distribution channel 130, which corresponds to the next weft yarn to be used for weaving during the next pick, with the weft insertion axis Y20. More precisely, the longitudinal axis Y130 of a selected distribution channel 130 can be aligned with axis Y20 by a vertical movement of the carriage 102. This vertical upward or downward movement of the carriage 102 is made with respect to the frame 140 and can be understood by the comparison of the two configurations of the weft selector 28 represented on FIG. 3. In this description, a distribution channel 130 is said to be aligned with the weft insertion axis Y20 when its longitudinal axis Y130 is aligned with this axis Y20. In the left configuration of FIG. 3, the upper distribution channel 130 of the carriage 102 is aligned with axis Y20 whereas, in the right configuration, the fifth distribution channel 130 starting from the top of the carriage 102 is aligned with axis Y20.

A stroke of the movement of the carriage 102 is defined by the drive assembly 103. This stroke corresponds to a movement of the carriage 102 between the position represented on the left of FIG. 3 and a position where the lowest distribution channel 130 is aligned with the weft insertion axis Y20. This stroke is about 140 mm for the carriage 102 of the example of the figures, which include twelve distribution channels 130.

A basket 150 is supported by the frame 140 of the multi weft selector 28 and is adapted to receive a head 202 of the rapier 20 which carries the gripper 40.

The gripper 40 has two jaws 42.

The basket 150 has two guiding surfaces for positioning the rapier head 202 warp-wise and vertically with respect to the weft selector 28. More precisely, the basket includes a horizontal lower surface 152, parallel to axis Y20 and an upper beveled surface 154 which is inclined towards the axis Y20 in the direction of the weft selector 28. The basket 150 is suitable for guiding the rapier head 202 along axis Y20, in the direction of arrow A5 on FIG. 5, that is towards the pick-up position for picking-up a weft yarn close to the forward bracket 116. This allows correctly positioning the gripper 20 with respect to a forward eyelet 126 of a distribution channel aligned with axis Y20, as shown on FIG. 5.

Figure 5:
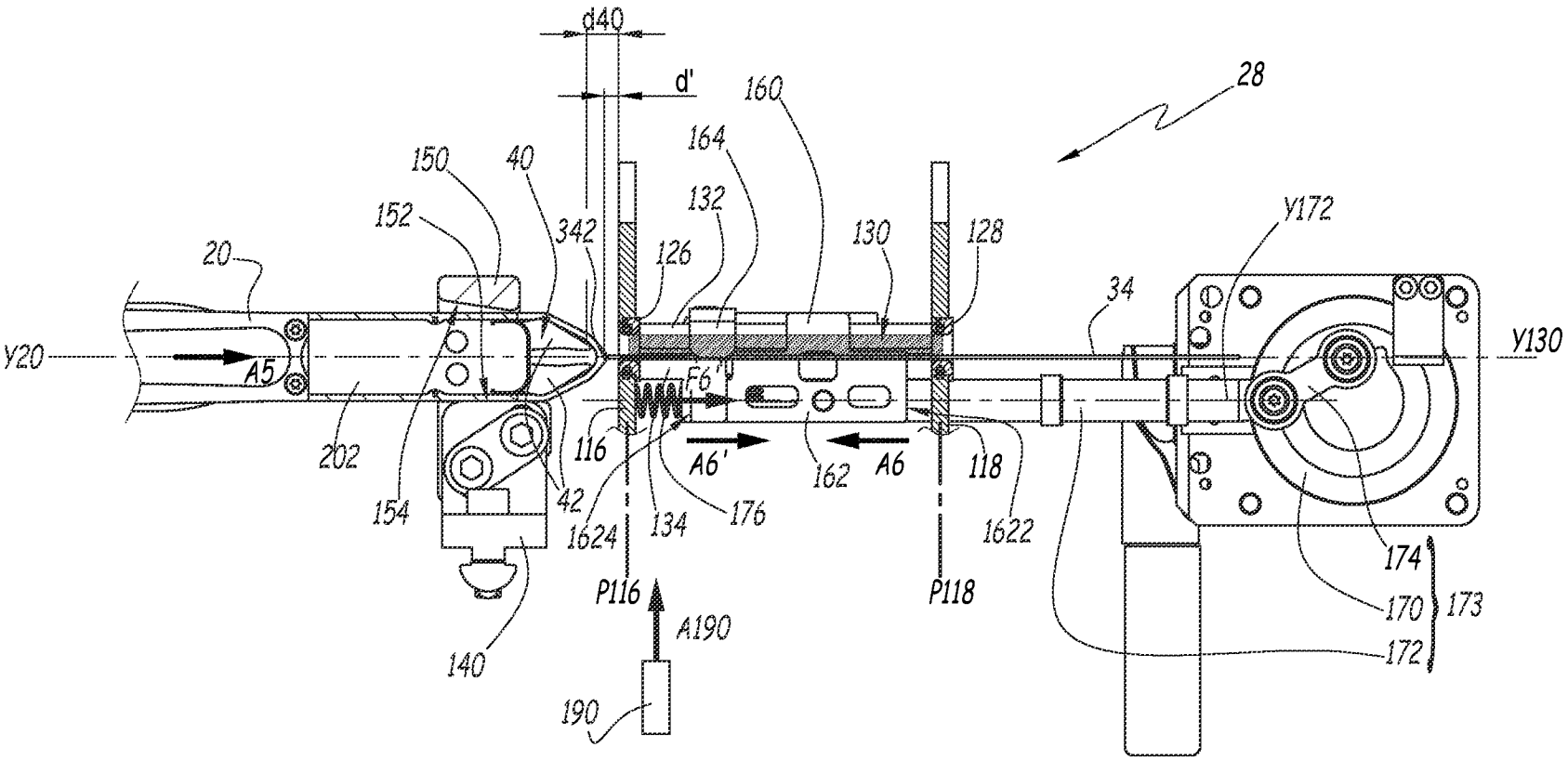
FIG. 5 is a partial cut view along plane P5 on FIG. 4.

According to a non-represented alternative embodiment of the invention and if the rapier 20 is stiff enough to reach the pick-up position represented on FIGS. 4 and 5, the basket 150 can be omitted. Alternatively, the basket can be replaced by any other alternative solutions, for example guiding means equipped with a slot, a ramp, a motion link or a crank for positioning the rapier.

Each distribution channel 130 is equipped with a weft presenter 160 slidably movable along axis Y130 and guided by two rails 132 and 134 parallel to this axis. A weft presenter 160 is not fully enclosed in the volume of the corresponding distribution channel 130, but it is located partly in this channel and partly outside this channel, between the brackets 116 and 118. For the sake of clarity, the two rails are shown only on FIGS. 5 and 7 to 10. They are represented, by their respective axes Y132 and Y134, on FIG. 11. Two housing 1626 and 1628 are provided in a main body 162 of each weft presenter 160, for accommodating a portion of the rails 132 and 134 with a small radial play, in order to allow the main body 162 to slide along the two rails 132 and 134.

Figure 6:
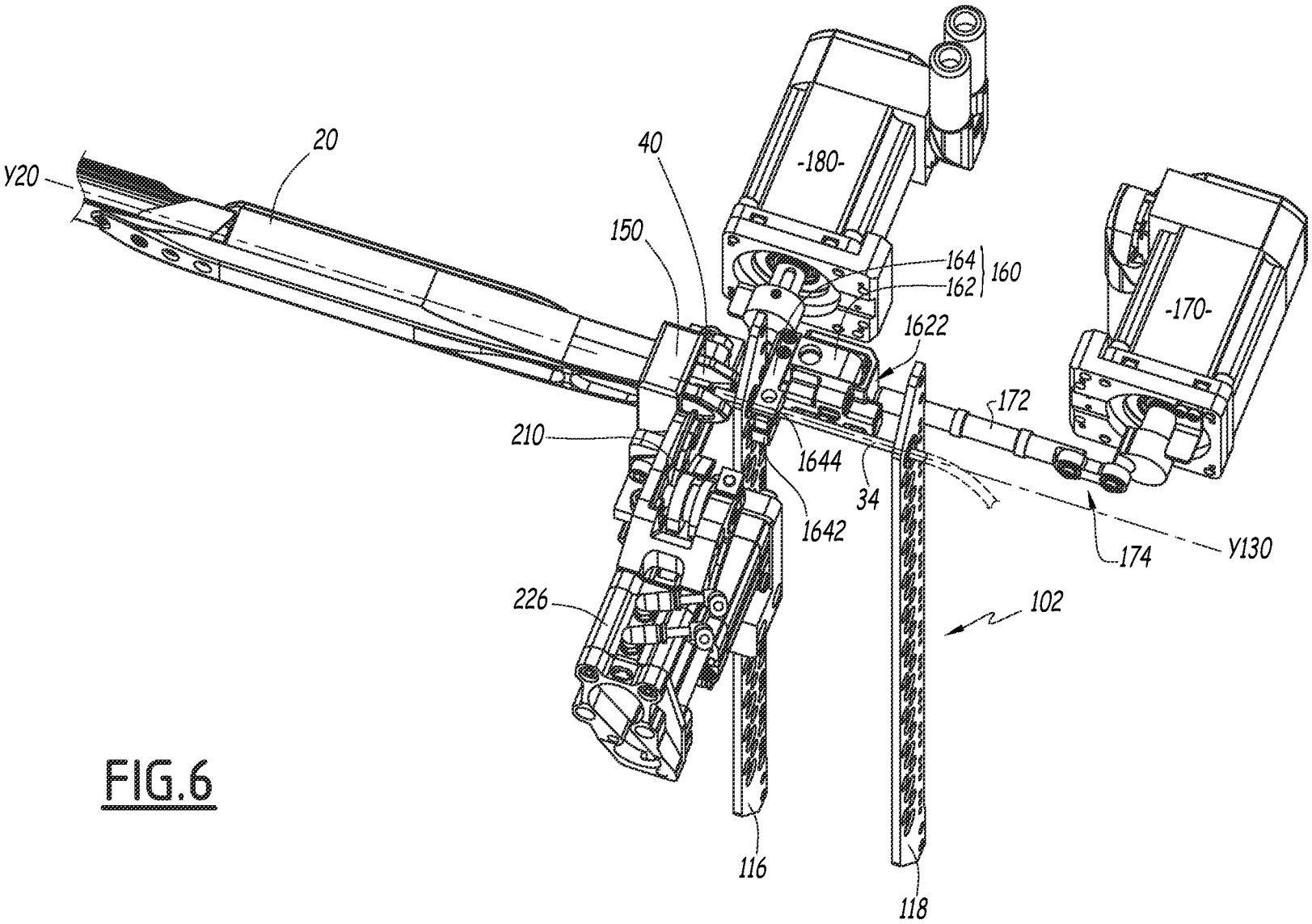
FIG. 6 is a perspective top view similar to FIG. 4, when the weft selector and the loom are in a second working configuration.

For the sake of simplicity, only one weft presenter 160 is represented on FIGS. 4 and 6. However, twelve weft presenters 160 can be mounted on the carriage 102, as visible on FIG. 3.

Each weft presenter 160 is movable along a distribution channel 130 between the forward and backward brackets 116 and 118. More precisely, each weft presenter 160 can slide along rails 132 and 134 between a backward or retracted position represented on FIGS. 4 and 5, where the weft presenter 160 is close to the backward bracket 118, and a forward position represented on FIGS. 6 to 10, where the weft presenter 160 is close to the forward bracket 116. The forward position of the weft presenter 160 is also a feeding position since, in this position, the weft presenter 160 can feed the gripper 40 with a weft yarn 34.

The displacement of each weft presenter 160, along the distribution channel 130 where it is engaged, between the forward and backward brackets 116 and 118 occurs along the longitudinal axis Y130 of this distribution channel 130 and along the weft insertion axis Y20. This displacement is obtained by an electric motor 170 which drives a rod 172 in translation along an axis Y172 parallel to axes Y20, Y130, Y132 and Y134, via a crank mechanism 174. The electric motor 170 is fixedly mounted on the frame 140 and piloted by the ECU 82. The electric motor 170, the rod 172 and the crank mechanism 174 together form an electric drive assembly 173 for moving a selected weft presenter 160 towards the font bracket 116.

A spring 176 is interposed between the weft presenter 160 and the forward bracket 116.

Figure 7:
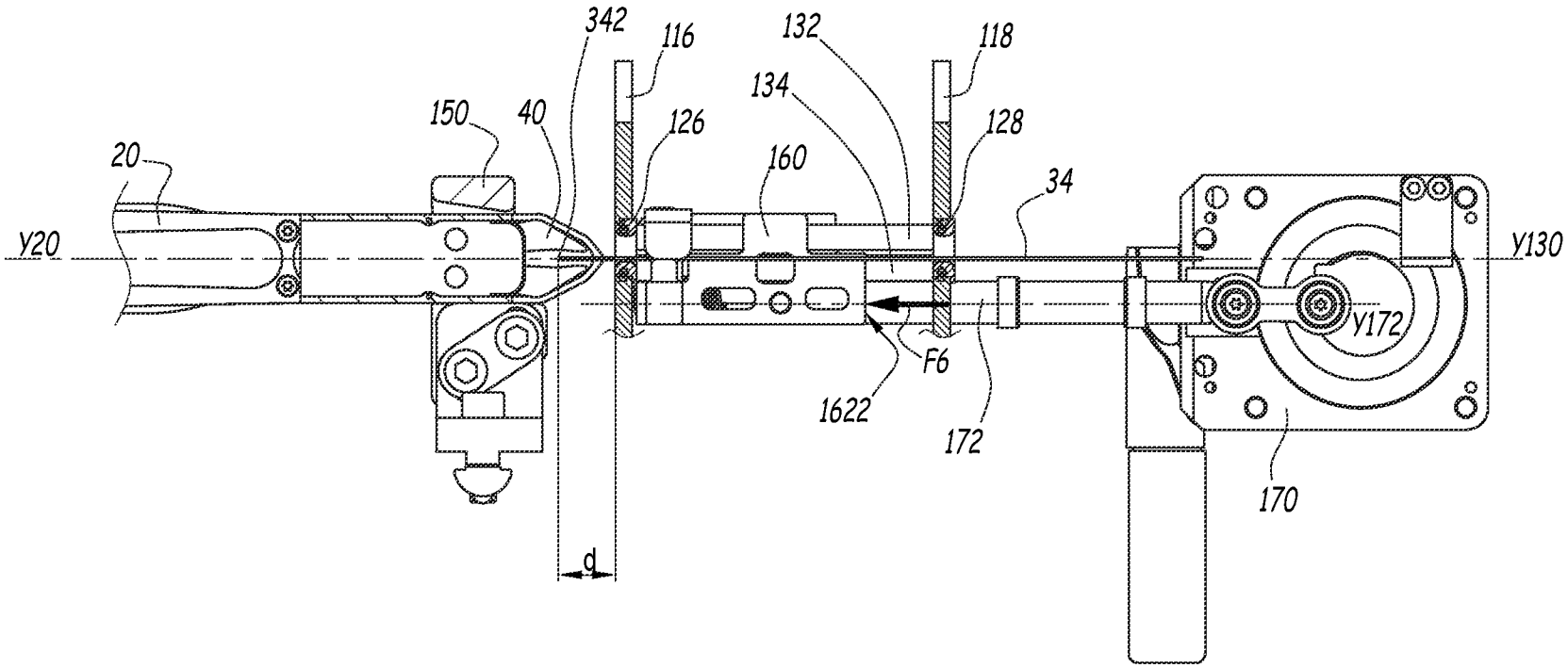
FIG. 7 is a partial cut view along plane P7 on FIG. 6.

Forward movement of the weft presenter 160, from its position of FIG. 5 to its position of FIG. 7, occurs in the direction of arrow A6 on FIG. 5 under the action of a force F6 exerted by the rod 172 actuated by the crank mechanism 174, this force being aligned along axis Y172. This force F6 is a pushing force exerted on a back side 1622 of the main body 162 of the weft presenter 160. Using the electric drive assembly 173, including an electric motor 172, a crank mechanism 174 and a rod 172 lying against the main body 162, for moving the weft presented 160 in the direction of arrow A6, provides a smoother forward movement of the weft presenter 160, than what could be obtained with a pneumatic drive. Thus, the pulling effort exerted on a weft yarn 34 by the associated weft presenter 160 to unwind it from its bobbin 26 is smoother.

A backward movement of the weft presenter 160, from its position of FIG. 7 to its position of FIG. 5, occurs in the direction of arrow A6' on FIG. 5, under the action of an elastic force F6' directed toward the backward bracket 118 and exerted by the spring 176 on a front side 1624 of the main body 162. Thus, the spring 176 constitutes elastic return means configured to push back the weft presenter 160 towards the retracted position represented on FIGS. 4 and 5.

The weft presenter 160 also includes a clamp 164 formed of a fixed clamp jaw 1642 and a movable clamp jaw 1644. The fixed jaw 1642 is stationary with respect to the main body 162. The movable jaw 1644 is articulated on the main body around a non-visible axis, perpendicular to axes Y132 and Y134.

Since each clamp 164 belongs to a weft presenter 160, it is movable, along a longitudinal axis Y130 of a distribution channel 130 and together with the main body 162 of this weft presenter, between a backward or retracted position, represented on FIGS. 4 and 5, and a forward or feeding position, represented on FIGS. 6 to 10.

A spring 166 is mounted on the main body 162 of each weft presenter 160 and pushes by default the movable jaw 1644 toward the fixed jaw 1642, in a position where the clamp 164 holds a portion of a weft yarn 34 fixed with respect to the weft presenter 160. In other words, by default, the weft yarn 34 is clamped by the clamp 164, as shown by arrow A11 on FIG. 11.

The fixed jaw 1642 has a U shape groove configured to accommodate a nose part 1643 of the movable jaw 1644. The geometry of the two jaws 1642 and 1644, in particular of the nose part 1643, is chosen in order to limit the risks of damaging a weft yarn 34 clamped by clamp 164. The U shape of the fixed jaw 1642 is particularly adapted for guiding different kinds of weft material and for securing the weft yarn 34 with respect of the main body 164, so that the weft yarn is prevented from slipping out of the clamp 164, in case of a loose yarn or a waving yarn.

In the example of the figures, all clamps 164 and all springs 166 and 176 of all weft presenter 160 are identical. However, in a non-represented alternative embodiment, the clamps 164 and the springs 166 and 176 can be customized for each weft presenter 160 in order to perfectly suit the geometry and type material of the weft yarn 34 going through the corresponding distribution channel 130.

An electric motor 180 is provided for controlling the opening movement of the respective clamps 164, against the elastic effort exerted by the corresponding springs 166. This electric motor 180 is rigidly mounted on the frame 140 and piloted by the ECU 82. It is located next to the basket 150 and positioned in such a way that it can interact with the clamp 164 of the weft presenter 160 of the single distribution channel 130 which is aligned with the weft insertion axis Y120, when this weft presenter has been moved to its forward position. In other words, a single electric motor 180, suitably piloted by the ECU 82, is used for selectively actuating the clamp 164 of any weft presenter 160, when such a weft presenter 160 is located in a distribution channel 130 aligned with the rapier 20, in particular with its gripper 40, and when the weft presenter is in its feeding position.

The electric motor 180 drives a roller 182 via an eccentric 184. Parts 180, 182 and 184 together form an electric drive 183 for maneuvering the clamp 164 of a weft presenter in its forward or feeding position. The roller 182 is designed for selectively lifting the movable jaw 1644 with respect to the fixed jaw 1642, on a distance of about 3 mm.

When the electric drive 183 does not act on a clamp 164, this clamp 164 closes with respect to an horizontal plane, under the elastic force exerted by the spring 166, so that the clamped weft yarn 34 remains substantially straight in the corresponding distribution channel 130. In other word, it is not necessary to bend a weft yarn 34 going through a distribution channel 130 for clamping this weft yarn.

Because of the location of the electric motor 180 with respect to the frame 140, the roller 182 only interacts with the clamp 164 of a weft presenter 160 when this weft presenter has been pushed forwardly by the electric motor 170, in order to reach the forward or feeding position represented on FIGS. 6 to 10. In other words, the clamp 164 of a weft presenter 160 can be opened by the electric motor 180 only if the weft presenter is located in a distribution channel 130 aligned on the axis Y20 and if this weft presenter 160 has been previously pushed forwardly into the feeding position by the electric drive assembly 173.

A vertically oriented optical sensor 190, which is visible on FIG. 5 only and which has a direction of observation represented by arrow A190, is installed in a lower portion of the weft selector 28, under the movable carrier 102, and supported by the frame 140. This sensor 190 allows determining if at least one weft presenter is in its forward or feeding position or if all weft presenters 160 are in their backward or retracted position. This sensor 190 can also check the opening status of a clamp 164 when this clamp belongs to a weft presenter which is in its forward or feeding position. Alternatively, checking of the status of the clamp 164 can be made with another non represented sensor.

The output signal of the sensor 190 is taken into account by the ECU 82 in order to actuate the electric drives 103, 173 and 183. In particular, the electric drive 103 cannot be actuated if one of the clamps is in its forward position, a fortiori if it is open.

A cutting tool 210 is installed next to the basket 150 and includes an upper blade 212 and a lower blade 214. The upper blade is stationary with respect to a body 222 of a cutting unit 220, which includes a first linear pneumatic drive 224, for moving the cutting unit 220 along a horizontal axis X220 perpendicular to axis Y20, and a second pneumatic drive 226, for moving the lower blade 214 with respect to the upper blade 212, when it is necessary to cut a weft yarn 34. Fluid connectors 2262 and 2264 connect the pneumatic drive 226 to non-represented tubes of air.

In this example, a single cutting unit 220, thus a single cutting tool 210 is used for selectively cutting the weft yarns 34 going through any distribution channel 130 of the movable carriage aligned on the weft insertion axis Y20.

Non-represented sources of air under pressure are also controlled by ECU 82 for providing air to pneumatic drives 224 and 226.

Figure 12:
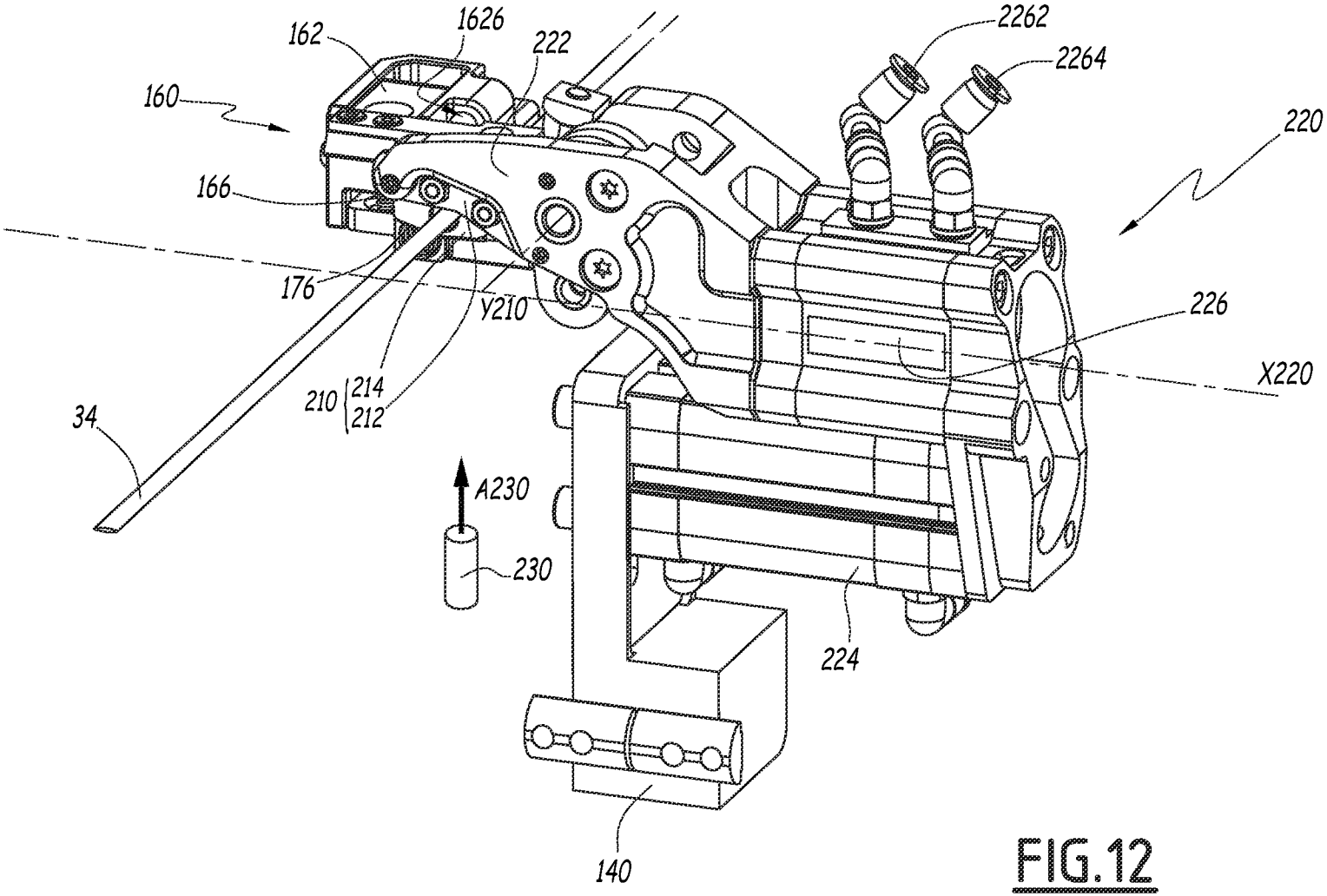
FIG. 12 is a perspective view of a cutting tool and a weft presenter which belong to the weft selector of the invention.

An optical sensor 230, which is represented on FIG. 12 only and whose direction of observation extends in the direction of arrow A230, allows detecting the position of the blades 212 and 214 with respect to one another, in particular when crossing of the blades occurs, that is when a weft yarn 34 is being cut. Its output signal is also provided to the ECU 82.

In the domain of three dimensional weaving, it is an issue to insert superposed weft yarns, especially when one uses a double rapier system. Since the final fabric is relatively thick in such an application, the Jacquard system opens different successive sheds at different heights with respect to the frame of the weaving machine 10, that is different heights with respect to the ground G. On the other hand, in order to optimize the weaving process, it is better to keep the shed height relatively small.

In order the facilitate weft insertion in different sheds located at different heights, the weaving loom 2 of the invention includes an elevation system 300 comprising a first lifting device 310 for vertically moving the rapier unit 200 and a second lifting device 320 for vertically lifting the weft selector 28.

Figure 13:
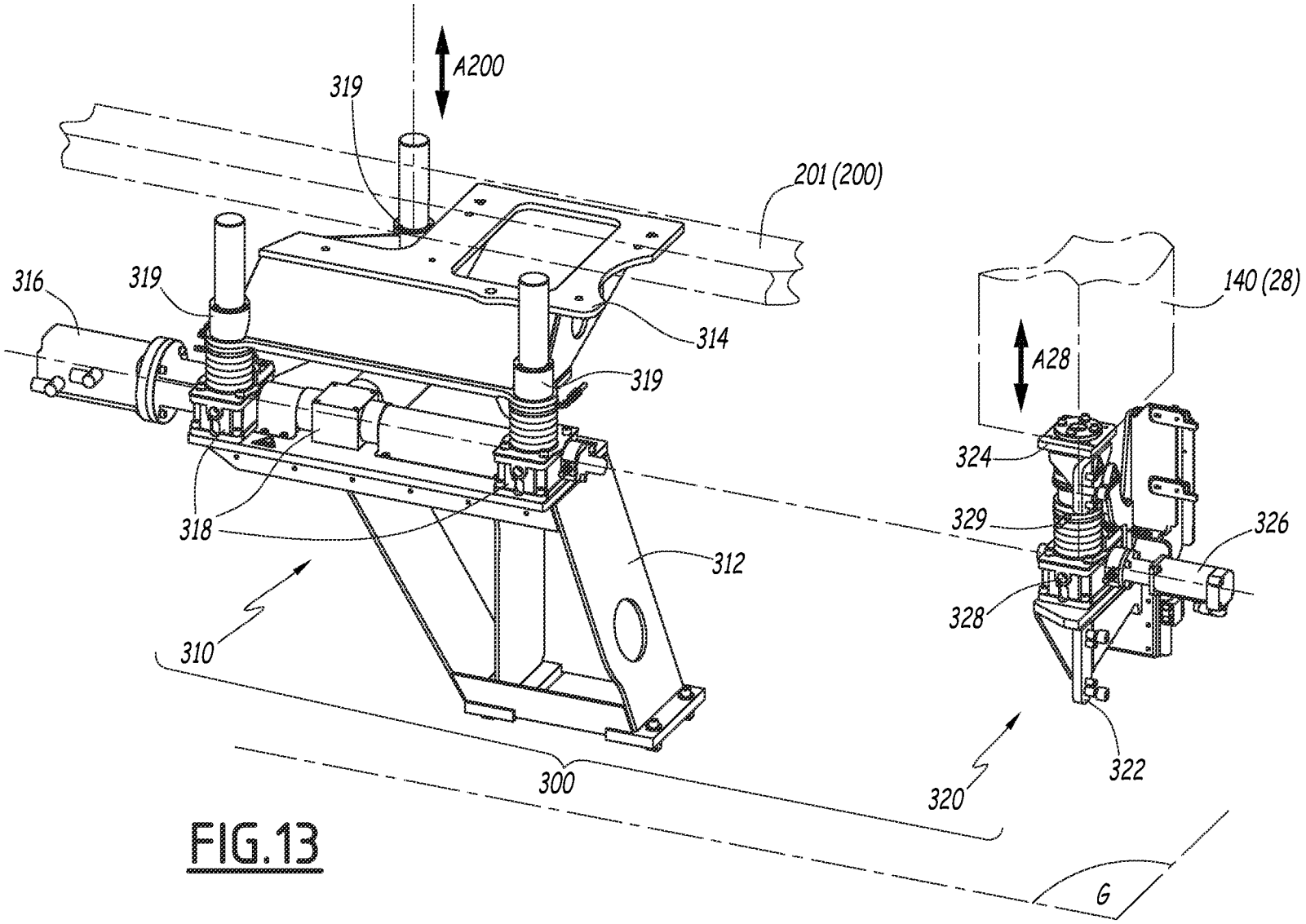
FIG. 13 is a perspective view of a drive assembly for adjusting the height of some parts of the loom of FIG. 1

On FIG. 13, where only the elevation system 300 is schematically shown, the guide rail 201 represents the rapier unit 200 and the frame 140 represents the weft selector 28.

The first lifting unit 310 includes a stationary frame 312, fixed on the ground G, and a movable frame 314 for supporting the rapier unit. A servo-drive 316 drives three worm gears via three angular gear boxes 318. This allows vertically and simultaneously moving three ball-screw spindles 319. Thus, the vertical elevation of the movable frame 314 can be controlled, while keeping the movable frame 314 parallel to the ground G.

On the other hand, the second lifting device 320 includes a stationary frame 322, fixed on the ground G, and a movable frame 324 for supporting the frame 140 of the weft selector 28. A servo-drive 326 drives a gear box 328 and a ball-screw spindle 329 in order to move vertically the movable frame 324.

The two lifting devices 310 and 320, in particular their respective servo-drives 316 and 326, are electronically controlled by the ECU 82, in order to obtain the same displacement, in terms of direction, speed and acceleration, of the two movable frames 314 and 324 at any time. One servo-drive can be a master and the other one is a slave.

This allows keeping the weft selector 28 horizontally aligned with the weft insertion mechanism 200 at all time, also when weft yarns are inserted successively into superposed sheds, by moving vertically together the weft insertion mechanism 200, as shown by double arrow A200, and the weft selector 28, as shown by double arrow A28. Thanks to the system 300, it is possible to adjust the vertical position of the weft insertion mechanism 200 and of the weft selector 28, thus the vertical position of the weft insertion axis Y20 and of the selected distribution channel 130, with respect to the ground G and to the weaving machine 10, in particular to the woven fabric 22. Lifting of the weft insertion mechanism 200 and of the weft selector can overlap over time with adjusting the position of the movable carriage 102, so as to reduce the downtime.

Alternatively, the two lifting devices can be mechanically coupled via a common shaft. In such a case, a single drive can be used, for instance the servo-drive 316. The common shaft can be coaxial with the shaft of the servo-drive of the reed considered here below and represented on FIG. 14.

It is known from the prior art to use a reed, also called a sley, articulated on the main shaft of the weaving machine via a mechanical cam connection. The reed beats-up each weft yarn into the fabric, in order to stabilize its position. The movement of the reed depends on the cam profile and cannot be adapted without changing the mechanical cam connection, which is complicated. The motion of the reed is basically a circular motion, which is not favorable for some weft material, in particular weft material including carbon structures.

In the weaving loom 2 of the invention, the alternative movement of the reed 23, represented by double arrow A23, is obtained by an independent drive mechanism 400 which includes an electric motor 412, a set of connecting rods 414, a crank mechanism 416 and a sub-frame 418 articulated on a main shaft 420 via two brackets 422. A flywheel 444 also belongs to the drive mechanism 400.

Figure 2:
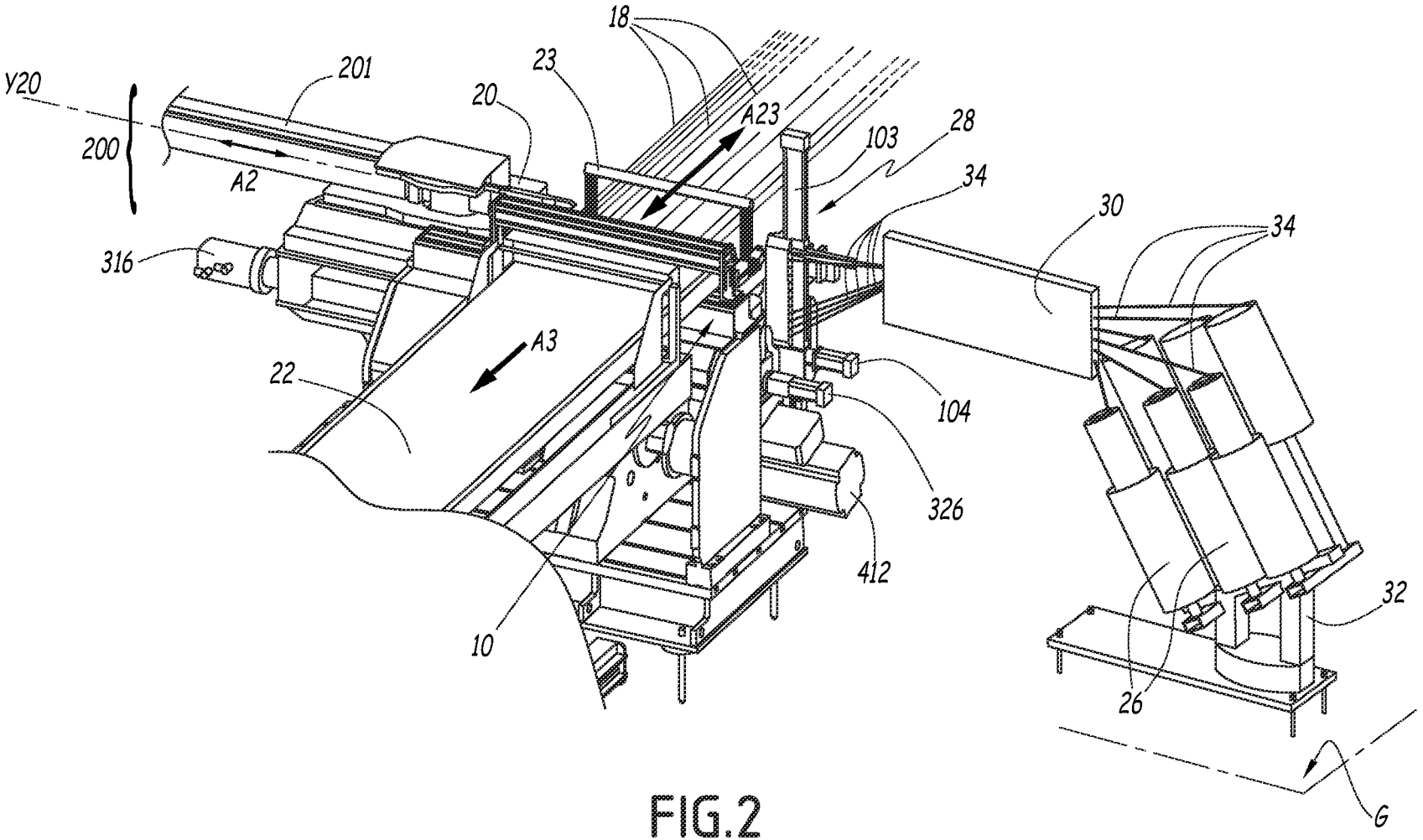
FIG. 2 is an enlarged view of detail II on FIG. 1, where the harness has been omitted for the sake of simplicity.
Figure 14:
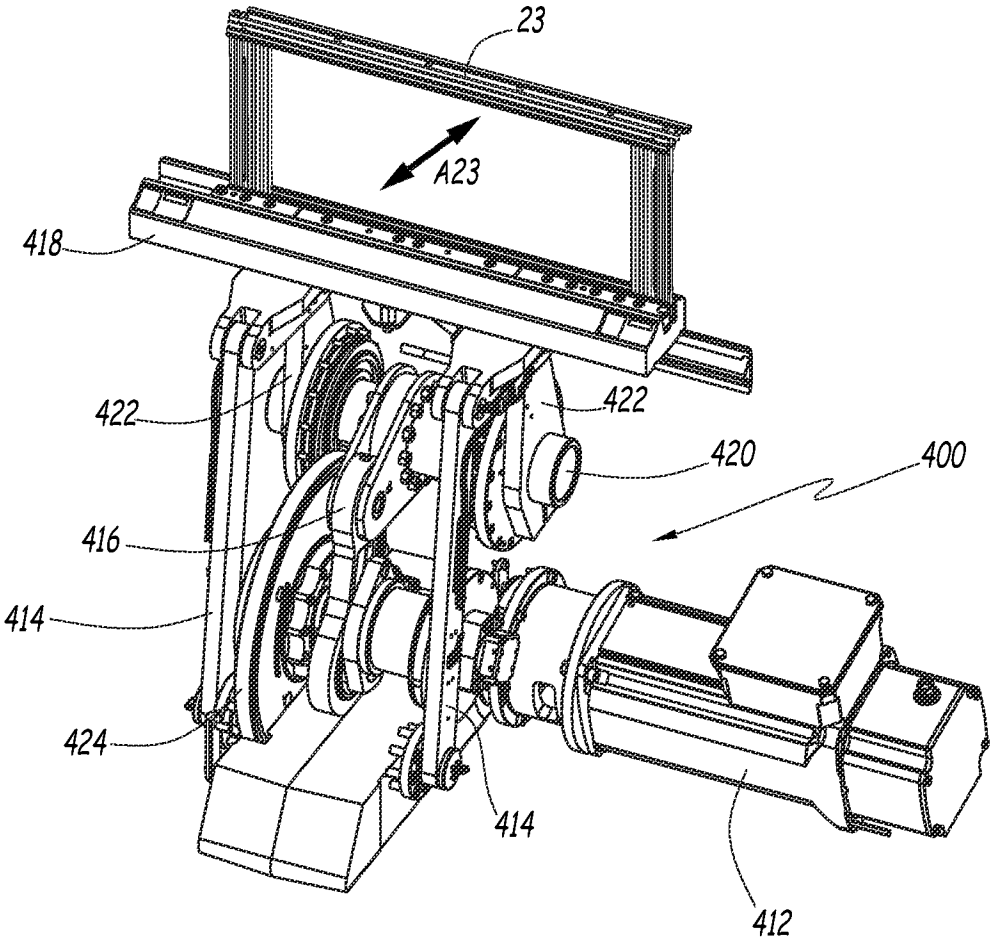
FIG. 14 is a perspective view of a reed and the associated drive, which belong to the loom of FIG. 1.

This drive mechanism 400 allows transforming the continuous rotation of movement of the electric motor 412 into an alternative horizontal movement represented by arrows A23 on FIGS. 2 and 14. The structure of the drive mechanism 400 allows a section of the reed 23 to overhang, since only one side of the reed is connected to the drive mechanism 400.

Thanks to the transformation of the movement obtained via the drive mechanism 400, the motion of the reed 23 is mainly horizontal, which is advantageous for weaving and beating-up a multi-layer fabric 22 with considerable thickness. The result obtained is better than with a rotational reed, where the most beaten-up part is the highest layer of the fabric.

Since the motor 412 is an electric motor, its working conditions can be piloted by the ECU 82 and easily customized. The direction of rotation of this electric motor 412 can be quickly inverted. The stroke, speed and acceleration of the reed movement can be adjusted, so that the duration and acceleration of the reed movement can be easily modified. Since the reed 23 is servo-driven, its motion is independent from the motion law of the Jacquard machine 6 and from the cutting and weft insertion process. The acceleration, speed, position and amplitude of the movement of the reed 23 can be easily adapted to the weaving process, to the material of the yarns and to the actual structure of the woven fabric 22.

The force exerted by the reed 23 on the fabric can also be measured, or determined by computation, in particular on the basis of the torque generated by the motor 412. This allows adapting the stroke of the reed depending on the fabric to be woven, on the material of the yarns, on the speed of the weaving process, etc. In particular a measure of the torque and its interpretation by the ECU 82 of the weaving loom 2 gives an idea of the tension of the yarns, which can be monitored and adjusted by non-represented means.

A weaving method implemented with the weaving represented on FIGS. 1 to 14 is explained here below.

If necessary, the system 300 can be used to lift the weft insertion mechanism 200 and the weft selector 28 in order adapt to the actual height of the shed and the position of the weft yarns with respect to the ground G. This can be done at the beginning of the weaving of a new fabric or during weaving, in particular between two weft insertion cycles.

Every time the rapier head 202 goes back to the pick-up position, its gripper is opened by a non-represented mechanism, known per se, so that a closable volume of reception of the weft extremity is formed. Alternatively, the rapier head 202 is openable before reaching the pick-up position along the weft axis.

The sensor 190 is used to monitor the position of all weft presenters 160 in their respective distribution channels 130, in order to check that no weft presenter 160 and no clamp 164 is in its forward or feeding position. This allows avoiding a collision between a weft yarn 34 and the movable carriage 102 during its vertical displacement.

Depending on the next weft yarn to be used for weft insertion at the next pick, called "selected yarn", one of the distribution channels 130 is selected by the ECU 82. The selected distribution channel is the one where the selected yarn is located.

Then, the drive assembly 103 is piloted by the ECU 82 to move or hold the movable carriage 102 vertically, in order to align the selected distribution channel 103 on the weft insertion axis Y20. In other words, the selected weft yarn 34 is aligned with the gripper. This can occur during the shed opening. If the selected yarn is different from the one used at the previous pick, this implies a vertical movement of the movable carriage 102. If the selected weft is the same as the one used at the previous pick, the movable carriage 102 is not moved and the distribution channel 130 previously selected remains aligned with the weft insertion axis. The rapier head open before positioning the movable carriage 102 of the weft selector 28. Alternatively, the rapier head opening can overlap in time with the positioning the movable carriage 102, so that the gripper 40 is aligned with a selected weft yarn 34.

Then, the electric motor 170 is actuated in order to push, via the rod 172 exerting the pushing force F6, the weft presenter 160 located in the selected distribution channel 130 forward, that is toward the forward bracket 116. Since the clamp 164 is, by default, closed by the spring 166 as shown by arrow A11 on FIG. 11, this forward movement of the weft presenter 160 represented by arrow A6 induces a similar forward movement of the weft yarn 34, which is clamped by the clamp 164 and pulled from the corresponding bobbin 26. Here, the clamp 164 of the weft presenter 160 in the selected distribution channel 130 is moved from its retracted position to its forward position, by the electric drive assembly 173 piloted by the ECU 82. During this forward movement of the clamp 164 and of the clamped weft yarn 34 within the clamp 164, the gripper 40 remains open, as shown on FIG. 7.

This allows reaching the forward position of FIGS. 6 and 7 of the weft presenter 160 and the clamp 164, against the elastic force F6' exerted by the spring 176. In this position, as shown on FIG. 7, the weft yarn 34 is clamped by the clamp 164 and its free extremity 342 protrudes out of the carriage 102, on a distance d measured parallel to axis Y20. The distance d is large enough for the free extremity 342 to extend between the jaws 42 of the gripper 40.

Therefore, in the forward position of FIGS. 6 and 7, the clamp 164 holds the weft yarn 34, in a position allowing feeding of the gripper 40.

Figure 8:
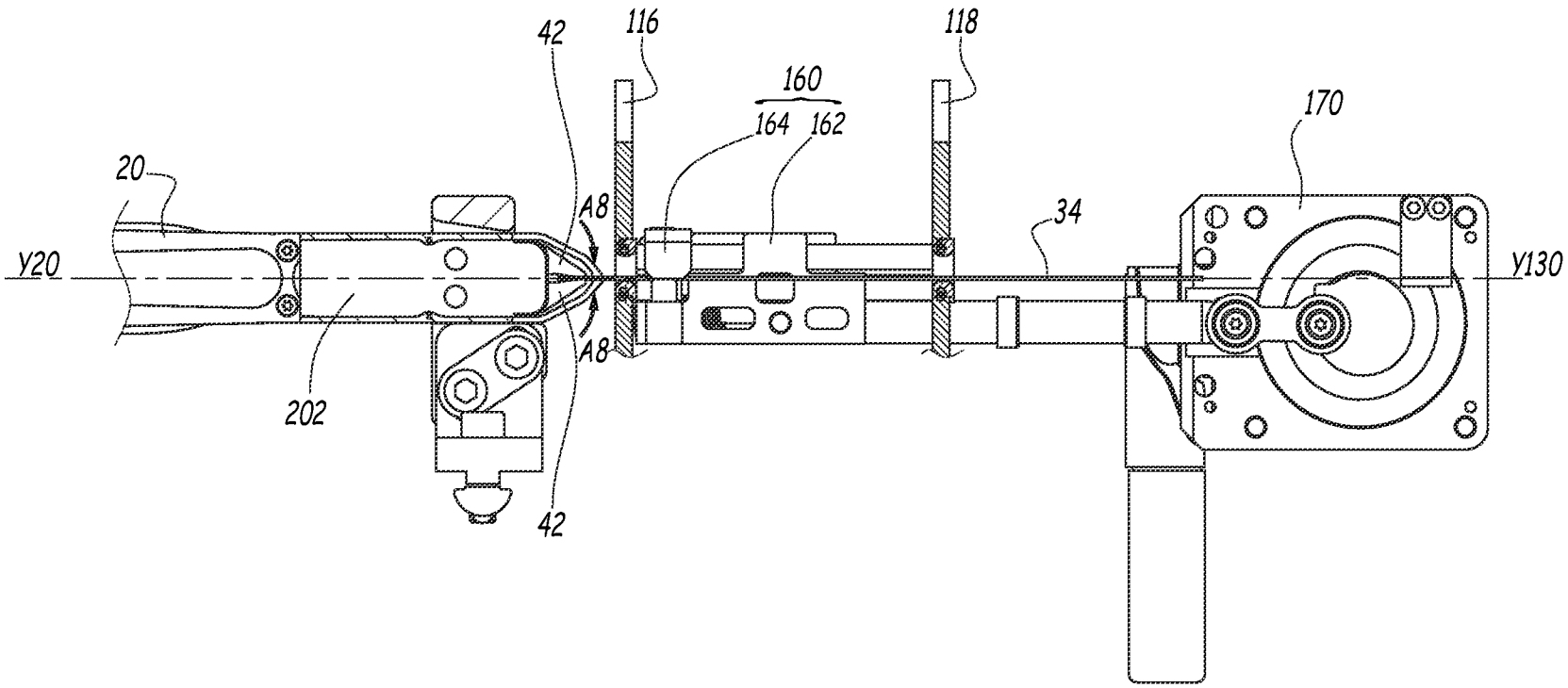
FIG. 8 is a cut view similar to FIG. 7, when the weft selector and the loom are in a third working configuration

It is then possible to close the gripper 40 by moving its jaws 42 toward each other by non-represented actuating means, as shown by arrows A8 on FIG. 8.

Figure 9:
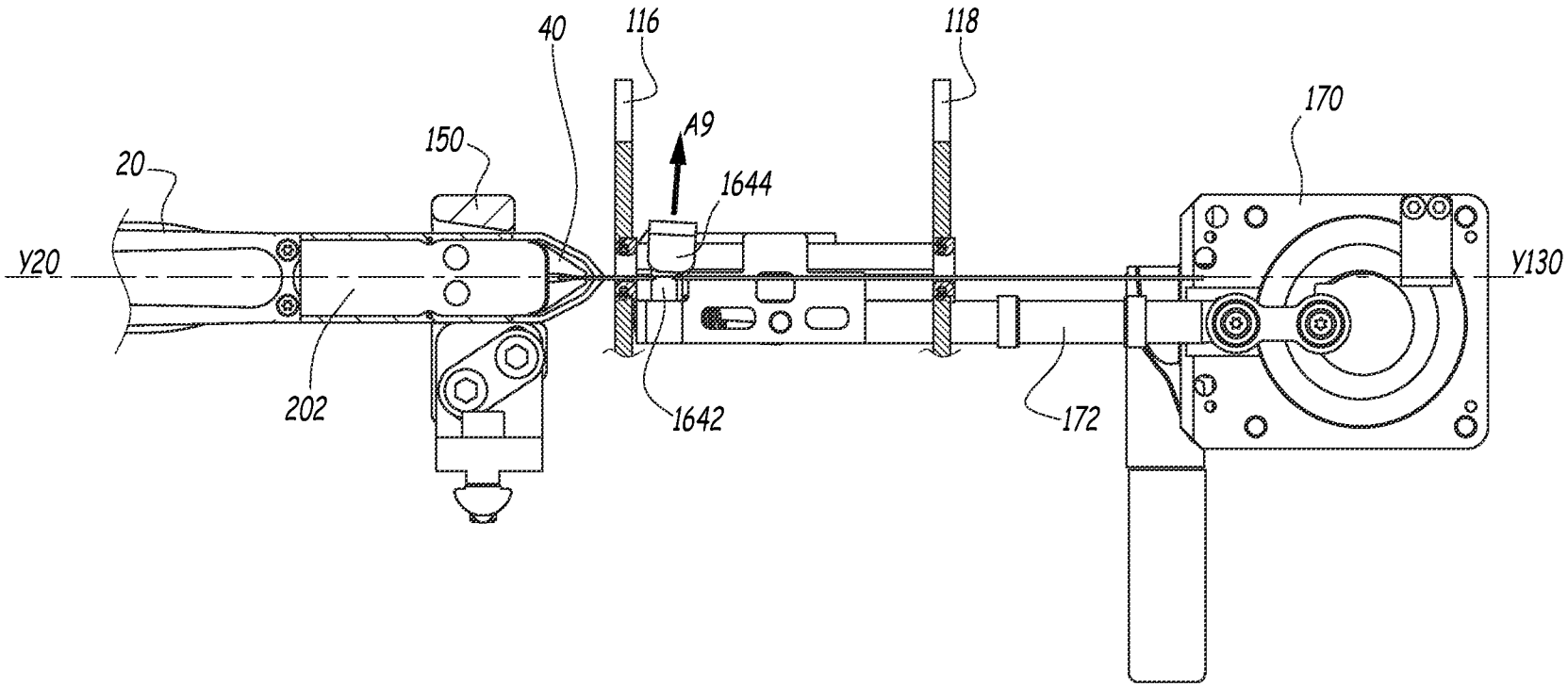
FIG. 9 is a cut similar to FIG. 7, when the weft selector and the loom are in a fourth working configuration.

Then, as shown by arrow A9 on FIG. 9, the clamp 164 is opened, by the action of the electric drive assembly 183, as explained here-above. This releases clamping of the selected weft yarn 34 and disconnects the weft yarn from the weft presenter 160.

Figure 10:
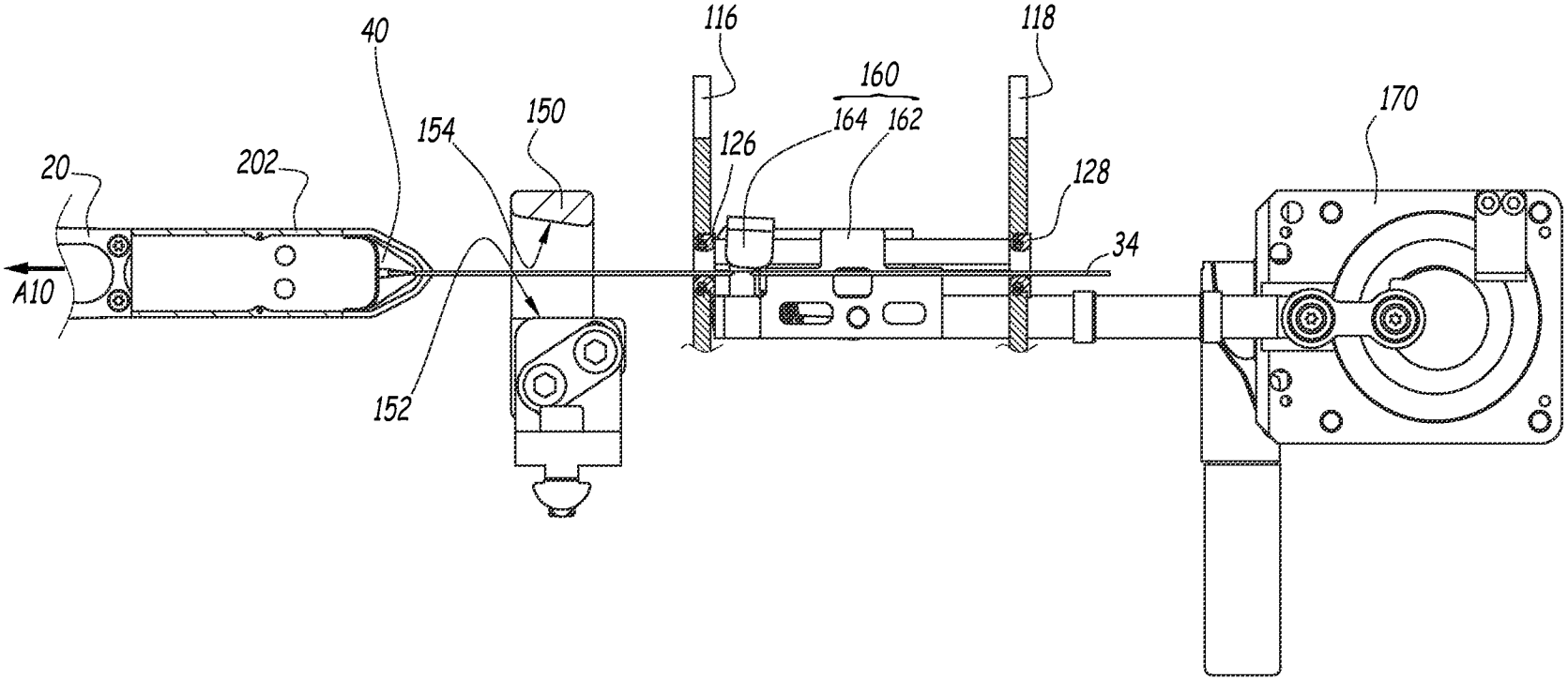
FIG. 10 is a cut view similar to FIG. 7, when the weft selector and the loom are in a fifth working configuration.
Figure 11:
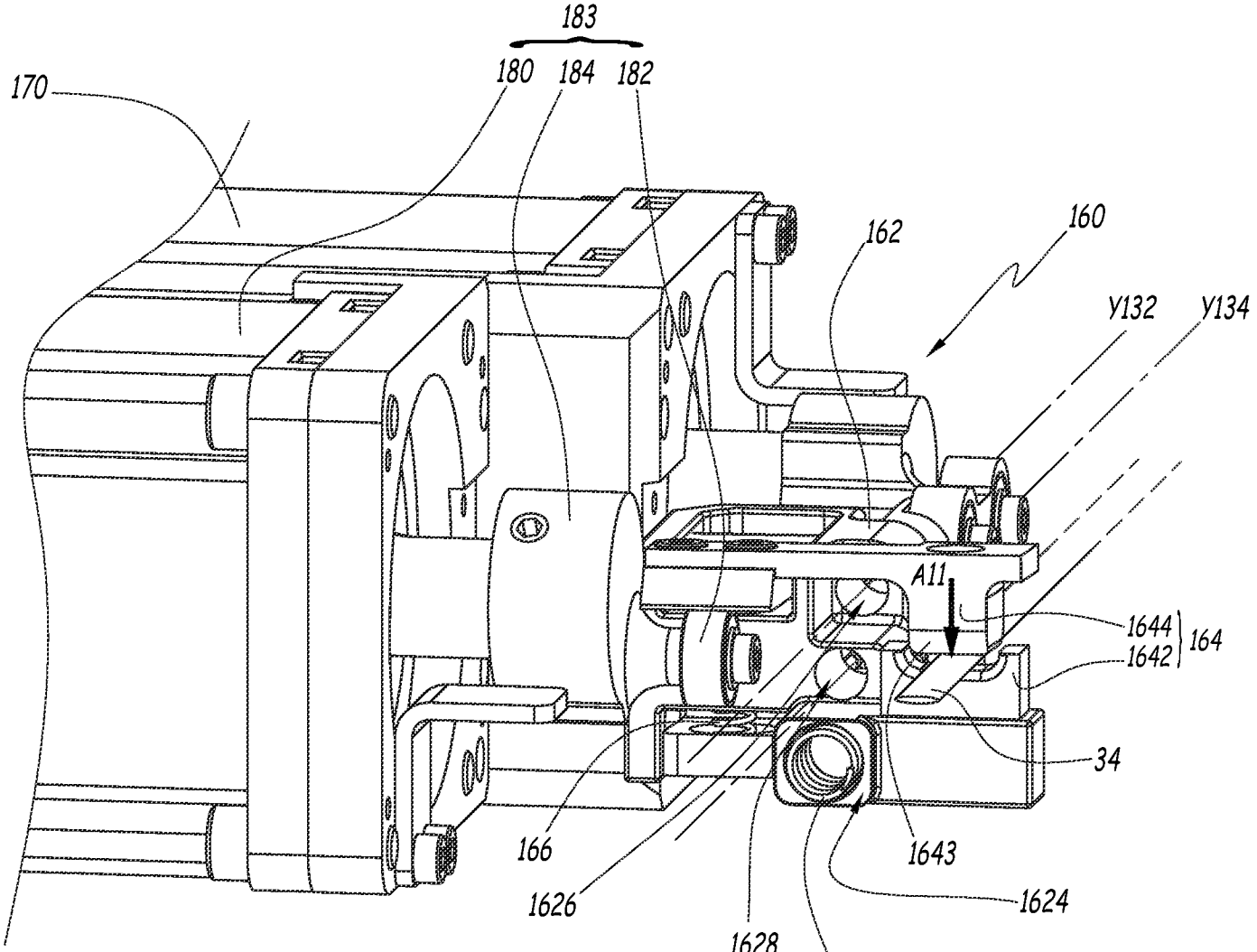
FIG. 11 is a perspective view, along another angle, of some parts of the weft selector of the invention.

Then, as shown in FIG. 10, the rapier 20 leaves the basket 150 and pulls the weft yarn 34 into the shed, in a forward direction represented by arrow A10. During this movement of the rapier through the shed, the weft yarn 34 unwinds from its bobbin. If necessary, a braking effort can be exerted by the clamp 164, in order to keep the weft yarn under tension. For this, the electric drive assembly 183 can be actuated by the ECU 82 to let the movable jaw 1644 move toward the fixed jaw 1642 under the elastic effort exerted by the spring 166, in order to exert a controlled braking effort.

The location where the weft yarn is cut is set by the position of the cutting tool 210 along the weft insertion axis Y20. Here, one can make use of the teachings of EP-A-3121317 in order to weave weft yarns of different lengths in the fabric 22. However, this is not compulsory. In such a case, the weft yarn 34 is cut at a preset length and, afterwards, the cut weft yarn 34 is drawn, in the forward direction A10, at a preset position into the shed.

When the rapier head 202 has reached the set position into the shed, the electric motor 180 is actuated again by the ECU 82, in order to let the clamp 164 close, under the action of the spring 166. Then, the weft yarn is clamped again for being cut and not being lost after cutting.

After the step represented on FIG. 10 and after clamping the weft yarn, the first pneumatic drive 224 is actuated in order to move the cutting unit 220 along axis X220 toward the yarn 34 extending through the basket 150.

Then, the second pneumatic drive 226 is actuated in order to move the lower blade 214 to cut the weft yarn 34. The sensor 230 can be used to control that cutting of the weft yarn is complete prior to moving to the next step. Then the cutting tool is opened again by the drive 226 and moved back to its original location by the drive 224.

Then, the electric drive assembly 173 is actuated in order to move backward the rod 172 which allows the spring 176 to push, via the elastic force F6', the weft presenter 160 backward, into its retracted position, toward the backward bracket 118, in the direction of arrow A6'. During this backward movement, the clamp 164 clamps the weft yarn 34 since it has been closed by a previous action of the motor 180, and the forward eyelet 126 guides the weft yarn 34.

Alternatively, the clamp 164 can be closed by leaving its forward position and the contact position with the roller 182. Alternatively, the clamp can start moving backward just before cutting the weft in order to create a necessary tension of the weft hold between the gripper and the clamp, so as to follow an efficient cutting operation. After cutting, the clamp ends its backward movement to its retracted position.

This brings the weft presenter 160, the clamp 164 and the weft yarn 34 back to the position of FIGS. 4 and 5 where the weft yarn extremity 342 still protrudes out of the movable carriage 102, through the front eyelet 126, by a distance d' smaller than the distance d and the clamp 164 still clamps the weft yarn 34.

Actually, the stroke S of the backward movement of the weft presenter 160, between the position of FIGS. 6 to 10 and the position of FIGS. 4 and 5, is equal to the difference between distances d and d'. The following equation applies:

$$S=d-d' \quad \text{(Equation 1)}$$

The stroke S is chosen so that distance d' remains strictly greater than zero. The following equations apply:

$$S<d \quad \text{(Equation 2)}$$

$$d'>0 \quad \text{(Equation 3)}$$

In other words, at the end of the backward movement of the weft presenter 160 and the clamp 164 in the selected distribution channel 130, the weft yarn extremity 342 protrudes out of the forward eyelet 126, in the direction of the weft insertion mechanism 200, over the distance d' which is not null. Thus, the weft yarn 34 is guided by the forward eyelet 126 of the corresponding distribution channel 130 and clamped by the clamp 164 during the backward movement of the clamp 164. The weft yarn is not disengaged from the forward eyelet 126 at the end of this backward movement. Therefore, next time the weft yarn 34 of this distribution channel will be used for the next pick, the free end 342 will already protrude out of the movable carriage 102 when the clamp 164 will start its movement toward its feeding position, in such a way that the gripper will surely grasp the weft yarn when it will close.

The value of the stroke S is chosen smaller than or equal to 12 mm, preferably smaller than or equal to 10 mm, still preferably smaller than or equal to 5 mm.

The distance d' is also chosen smaller than the distance d40, measured along axis Y20, between the gripper 40 and the forward bracket 116, when the rapier head 202 is in the basket 150. Thus, there is no risk of arming the respective weft yarn extremities 342 when the carriage 102 moves along axis Z28, even if the rapier head 202 is already in its pick up position.

Advantageously, the distance d is chosen larger that 1 cm, preferably equal to 1.2 cm, whereas distance d' is chosen, larger than 1 mm and smaller than 5 mm, preferably equal to 2 mm.

Alternatively, according to a first non-represented embodiment of the method of the invention, after the clamp 164 has been opened by the action of the electric drive assembly 183, and while the weft yarn 34 is pulled into shed, the electric drive assembly 173 can be actuated so that the clamp 164 is moved backward in the selected distribution channel 130, along the weft insertion axis Y20, on a distance equal to, for example, 2 mm, which is a stroke S1 smaller than the stroke S which is equal to, for example, 10 mm. The clamp 164 is stopped and the weft yarn 34 is clamped before it is cut at the preset length. Then, the electric drive assembly 173 is actuated for the weft presenter 160 to be pushed via the elastic force F6' exerted by the spring 176, in the direction of arrow A6', to the retracted position, with a stroke S2 equal to the difference between strokes S and S1, that is S2=S−S1, in this example 10 mm−2 mm=8 mm. A distance d" measured between the front eyelet 126 and the weft yarn extremity 342 which protrudes out of the movable carriage 102 is larger than the distance d' identified here above and such that the following equation applies: d"=d'+2 mm=d'+S1. The stroke S1 which can be considered as a preliminary backward stroke of the weft presenter 160, allows moving the weft extremity 342 further out of the weft presenter 160, into the jaws 42 of the gripper 40 so that the distance d" is increased compared to the distance d' of the embodiment represented on the figures. In other words, the weft yarn extremity 342 protrudes more than in the embodiment represented on the figures. The stroke S1 is advantageous to feed the gripper deeper, in particular to make it easier to pick up the weft yarn extremity 342 and maintain it within the jaws 42. This first alternative embodiment avoids having to change the geometry or distance between the cutting unit 220 and the weft presenter 160 to offer a longer weft extremity 342 to the gripper 40.

In a second non-represented alternative embodiment of the method of the invention, after the electric drive assembly 173 has moved the weft presenter 160 into its forward position with the clamp 164 holding the weft yarn 34, a second forward movement of the weft yarn 34 along the weft insertion axis Y20 can be operated by the weft selector 28 while the gripper is opened at the pick-up position.

This second forward movement of the weft yarn 34 along the weft insertion axis Y20 is implemented after opening the clamp 164 at its forward position and after moving the clamp 164 backward in the selected distribution channel 130. Then, the weft yarn 34 is clamped in the retracted position with the clamp 164, and moved to its forward position along the weft insertion axis Y20 in the selected distribution channel 130 into the gripper 40, by actuating the electric drive assembly 173 against the elastic force F6' exerted by the spring 176, while the gripper is opened at the pick-up position.

The second forward movement of the clamp 164, while it clamps the weft yarn 34, allows moving the weft extremity 342 further out of the weft presenter 160, into the jaws 42 of the gripper 40, so that the distance d' is increased, as compared to the first movement of the weft presenter 160 into its forward position. It is then possible to close the gripper 40 to catch the weft yarn 34 with more weft material within the jaws 42. This operation corresponds to a two-step mode of moving the weft yarn 34 into the gripper 40.

In a third non-represented alternative embodiment of the method of the invention, three steps or more than three steps can be successively operated by the weft presenter 160 of the selected distribution channel 130 and the clamp 164 to move the weft yarn 34 further into the jaws 42.

The stroke of each forward movement, the forward position of the weft presenter 160 and the retracted position along the axis Y20 can be adapted thanks to the ECU 82 through the proper driving of the electric drive assembly 173.

Alternatively, the jaws 42 of gripper 40 can move toward each other and catch the weft yarn 34 while the weft presenter 160 operates the backward movement of the clamp 164, so that the weft yarn 34 is not moved backward or lost.

Thanks to the construction of the weft presenter 28 of the present invention, with weft distribution channels 130 parallel to the weft insertion axis Y20 and with clamps 164 having a precisely controlled translational movement, it can be guaranteed that the free end 342 of a weft yarn to be introduced into the shed, which always protrudes out of the front eyelet 126 of such a distribution channel 130, can be efficiently picked up by the gripper 40 in the pickup position of the rapier 20.

Once the weft yarn has been cut and the corresponding weft presenter 160 has been moved back into its retracted position, the rapier 20 is pulled out of the shed and the reed 23 beats up the woven fabric 22, before a new weft insertion cycle begins.

The invention has many advantages including the following ones:

- It allows providing different kinds of weft material to a technical weaving loom 2
- It guarantees that the weft material is not twisted by the weft selector 28 or by the weft insertion mechanism 200.
- The structure of the weft selector 28 guarantees a direct delivery of the weft material to the rapier jaws 42 and there is no need to bend the yarn material.
- The invention allows offering a substantial length of weft yarn to the rapier head 202 for grasping the weft yarn 34, irrespective of the material smoothness of stiffness.
- When the weft material has a rectangular cross section, such as a tape, it is clamped and inserted into the shed along a substantially flat plane.
- The invention also guarantees a right position of any kind of weft material in the rapier head 202, whatever its rigidity.
- Because of the structure of the weft selector 28, delivery of a weft yarn is guaranteed, even if the weft yarn has not been used for a long time, since each clamp 164 remains closed as long as it is not in a selected channel and as long as it has not been pushed into its forward position.

The invention also guarantees a correct positioning of the gripper head 202 with respect to the forward guiding means formed by the forward eyelets 126, because of the use of the basket 150.

The invention allows using an optimal amount of weft material because no material is lost by closing the jaws 42 on the free end 342. This spares some yarn material, with respect to the existing solutions.

The invention also avoids the weft yarns ends 342 to be armed, if the gripper 40 is in the basket 150 and the movable carriage 102 moves, in so far as, in this configuration, the free ends 342 of the respective weft yarns 34 protrudes out of the carriage 102 on a relatively small distance d'.

The invention also allows optimizing the weft delivery during insertion, thanks to the braking possibility offered by the clamp 164 and thanks to a possibility of holding the weft yarn with the clamp, when necessary.

The invention also allows managing weft yarn cutting during a pick.

Moreover, the weft selector 28 of the invention operates quickly and can work mainly in hidden time for the weaving loom 2.

The weft selector of the invention is compact as compared to other known systems.

In a non-represented alternative embodiment of the invention, the weft insertion mechanism 200 may use a weft presenter different from a rapier.

According to alternative embodiments of the invention, instead of a Jacquard machine, one can use another type of shedding machine, such as a dobby, a cam machine or electrical actuators for moving the heddles which control the vertical position of the warp yarns.

According to another alternative embodiment of the invention the geometrical arrangement of the weft distribution channels 130 can be different from the one represented on the figures. Axis Z28 can be oblique or horizontal.

The weft selector 28 can be located on the right of the weaving machine 10, as shown on the figures, or on the other side.

According to another non-represented embodiment of the invention, two weft presenters 160 can move in parallel in order to bring their respective clamps 164 into respective feeding positions, so that two weft extremities 342 can be caught by the grippers 40 of two parallel and superposed rapiers. A solution with two rapiers moving side by side is also compatible with the invention.

The drive solutions can be changed. The motors can be electric, pneumatic or hydraulic. In particular, the cutting tool 210 can be powered by an electric motor with a crank mechanism, so that the trajectory of the movable blade can be changed and the blades of a cutting unit can cut the weft yarn at different places along the blades, so that the blades do not wear at a precise location. This increases the lifetime of the cutting tool 210. A solution with one clamp drive 183 for one channel 130 is compatible with the invention, but less economic than a single drive for all the channels.

In particular, the first linear pneumatic drive 224 can be replaced by a servo drive for moving the cutting unit 220 along the horizontal axis X220. In such a case, the positioning of the lower blade 214 and upper blade 212 with respect to the weft yarn 34 and to the axis Y20 is accurately controlled, so that the location of the cutting point of the weft 34 can be adjusted, by the ECU 82, as a function of the weft yarn properties, the yarn count, etc. Advantageously, one can use stochastic micro-variations in the positioning of the cutting unit 220 by the servo drive, with respect to the weft. This allows changing the contact surfaces of the lower blades 214 and the upper blade 212 used for the successive cutting operations. Thus, the lifetime of the lower blade 214 and the upper blade 212 can be improved.

Data exchange can be operated through the ECU 82 or another control unit of the weaving loom 2. Control of the weft selector 28 via an independent controller is also possible. The ECU can be located outside of control cabinets 8 or divided into several ECUs located in different cabinets.

The respective steps of the process of the invention can be overlap, in order to increase the overall speed of the process.

The process is particularly adapted to insert weft yarns with predetermined length, smaller than a full width of the woven fabric 22, as considered in EP-A-3121317. However, full width weft yarns are compatible with the invention.

The weft selector 28 of the invention can be used for other kinds of yarns and other weaving techniques than the ones mentioned here-above. For example, a similar weft selector could be used for presenting alternatively different types of weft yarns to a rapier in a carpet weaving loom.

The weft yarn extremity 342 can be bent around its main axis, so that the yarn is stiffer when going trough the weft selector 28. For example, the clamp 160 can have a rounded shape, which deforms the weft yarn extremity with a semi-tube shape, which does not tend to bend downward like a flat weft yarn extremity submitted to its own weight.

Forward guiding means made by the eyelets 126 and the clamp 164 could be assembled, if the weft yarn extremity 342 is guided in a long cannel.

The forward guiding means 126 could be mounted on an elastic system, at the front side of the movable carriage 102 and on the trajectory of the rapier 20, so that the rapier 20 can push the forward bracket 116 on a small stroke.

The embodiments and variants mentioned here above can be combined in order to generate new embodiments of the invention, in the framework of the attached claims.

The invention claimed is:

1. A method for weaving a fabric with warp yarns and in-woven weft yarns on a weaving loom which comprises:

heddles for moving the warp yarns in order to form a shed;

a shed forming mechanism for moving the heddles;

weft bobbins which provide weft yarns to the loom;

a weft insertion mechanism, for drawing-in a weft yarn from a pick-up position into the shed, along a weft insertion axis and in a forward direction, the weft insertion mechanism including a gripper openable at the pick-up position;

a weft selector including a movable carriage, the movable carriage defines two planes offset along the weft insertion axis namely a forward plane and a backward plane, said weft selector which defines several selectable distribution channels parallel to the weft insertion axis, each selectable distribution channel including a forward guiding member, for guiding a weft yarn toward the gripper, and a clamp;

this method including at least the following steps:

a) opening the gripper;

b) positioning a movable carriage of the weft selector, by a aligning a selected distribution channel on the weft insertion axis, so that the gripper is aligned with a selected weft yarn;

c) clamping the weft yarn in the selected distribution channel, with the clamp of this channel;

d) moving the weft yarn along the selected distribution channel toward the gripper, while the gripper is opened, by moving the clamp along the selected distribution channel;

e) catching the selected weft yarn with the gripper at the pick-up position;

f) drawing-in the weft yarn with the weft insertion mechanism, from the pick-up position into the shed, along the weft insertion axis and in the forward direction; and g) cutting the weft yarn.

2. The method of claim 1, wherein clamping of the weft yarn is released during step f).

3. The method of one claim 1, wherein it includes, after step g), the following step:

h) moving backward the weft yarn in the selected distribution channel, along the weft insertion axis, in a direction away from the gripper, preferably on a stroke inferior to a distance by which the weft yarn protrudes from the forward guiding member towards the gripper, along the weft insertion axis, prior to the beginning of the backward movement.

4. The method of claim 3, wherein, the weft yarn is guided by the forward guiding member during step h).

5. The method of claim 3, wherein the weft yarn is clamped by the clamp of the selected distribution channel during step h).

6. The method of one claim 1, wherein the weft yarn of the selected distribution channel is braked during step f).

7. The method of one claim 1, wherein the weft yarn of the selected distribution channel is cut at a preset length during step g) and the method includes, after step g), the following step:

i) drawing, in the forward direction, the cut weft yarn at a preset position into the shed.

8. The method of claim 1, wherein it includes, before step b), the following step:

j) lifting the weft insertion mechanism and the weft selector vertically or holding them in a vertical position, in order to adjust the vertical position of the weft insertion axis and of the selected distribution channel.

9. The method of claim 1, wherein it includes, after step e) and before step g), the following step:

j) moving backward the clamp in the selected distribution channel, along the weft insertion axis, in a direction away from the gripper.

10. The method of claim 1, wherein it includes, after step d) and before step e), the following steps:

d1) opening the clamp;

d2) moving the clamp backward along the selected distribution channel;

d3) clamping the weft yarn with the clamp (164);

d4) moving the weft yarn along the selected distribution channel further than in step d) into the gripper, while the gripper is opened at the pick-up position, by moving the clamp along the selected distribution channel.

11. A weft selector for delivering a weft yarn to a weft insertion mechanism for drawing-in a weft yarn from a pick-up position into a shed of a weaving loom, in a forward direction along a weft insertion axis, the weft insertion mechanism including a gripper openable at the pick-up position and movable along the weft insertion axis, wherein the weft selector including a movable carriage, the movable carriage defines two planes offset along the weft insertion axis namely a forward plane and a backward plane;

forward guiding members are positioned in the forward plane;

backward guiding members are positioned in the backward plane;

the movable carriage defines several distribution channels parallel to the weft insertion axis, each distribution channel extending between a forward guiding member and a backward guiding member;

the carriage is configured for aligning a selected distribution channel on the weft insertion axis;

each distribution channel is equipped with a clamp configured for holding a weft yarn in the distribution channel and mobile along the distribution channel in a forward direction and in a backward direction, between a feeding position, where the weft yarn extends into the pick-up position, and a retracted position, where the weft yarn is offset from the pick-up position along the weft insertion axis; and a drive assembly moves the clamp of the selected distribution axis along the weft insertion axis.

12. The weft selector of claim 11, wherein the movable carriage is movable along an axis perpendicular to the weft insertion axis.

13. The weft selector of claim 11, wherein, between its feeding position and its retracted position, the clamp has a stroke smaller than or equal to 12 mm, preferably smaller than or equal to 10 mm, still preferably smaller than or equal to 5 mm.

14. The weft selector of claim 11, wherein it includes a single clamp drive which is configured to selectively apply an opening force on the clamp of the distribution channel aligned with the weft insertion axis.

15. The weft selector of claim 11, wherein each distribution channel is equipped with a weft presenter, which supports the clamp, and an elastic return means, configured to push back the weft presenter towards the retracted position of the clamp and wherein the weft selector includes a single drive assembly for moving along the weft insertion axis, the weft presenter of any distribution channel aligned with the weft insertion axis.

16. The weft selector of claim 11, wherein it includes a basket, which is configured for guiding the gripper, at the pick-up position.

17. The weft selector of claim 11, wherein it includes three drive assemblies, namely:

a first drive assembly for positioning the movable carriage;

a second drive assembly for opening of the clamp of a distribution channel aligned with the weft insertion axis, when this clamp is in the feeding position;

a third drive assembly for moving, along the weft insertion axis, the clamp of the distribution channel aligned with the weft insertion axis toward the feeding position.

18. A weaving loom comprising:

heddles for moving warp yarns in order to form a shed;

a shed forming mechanism for moving the heddles;

weft bobbins which provide weft yarns to the loom;

a weft insertion mechanism, for drawing-in a weft yarn from a pick-up position into the shed, along a weft insertion direction, the weft insertion mechanism including a gripper openable at the pick-up position;

a weft selector, wherein the weft selector is according to claim 11.

* * * * *